US008199072B2

(12) United States Patent
Maeda et al.

(10) Patent No.: US 8,199,072 B2
(45) Date of Patent: Jun. 12, 2012

(54) PLASMA DISPLAY DEVICE AND METHOD OF DRIVING THE SAME

(75) Inventors: Toshiyuki Maeda, Hyogo (JP); Hidehiko Shoji, Osaka (JP)

(73) Assignee: Panasonic Corporation, Osaka (JP)

( * ) Notice: Subject to any disclaimer, the term of this patent is extended or adjusted under 35 U.S.C. 154(b) by 590 days.

(21) Appl. No.: 12/513,687

(22) PCT Filed: Dec. 7, 2007

(86) PCT No.: PCT/JP2007/073670

§ 371 (c)(1),
(2), (4) Date: May 6, 2009

(87) PCT Pub. No.: WO2008/072564

PCT Pub. Date: Jun. 19, 2008

(65) Prior Publication Data

US 2010/0039417 A1 Feb. 18, 2010

(30) Foreign Application Priority Data

Dec. 11, 2006 (JP) ..... 2006-332992

(51) Int. Cl.
*G09G 3/28* (2006.01)

(52) U.S. Cl. ..... 345/60

(58) Field of Classification Search ..... 345/214, 345/211, 60

See application file for complete search history.

(56) References Cited

U.S. PATENT DOCUMENTS 6,294,875 B1 9/2001 Kurata et al.
7,138,988 B2 11/2006 Kigo et al.
7,142,202 B2 11/2006 Kigo et al.
7,375,722 B2 5/2008 Kigo et al.
2003/0011540 A1 1/2003 Tokunaga et al.
2004/0113871 A1 6/2004 Kashio et al.
2004/0212560 A1 10/2004 Son et al.
2005/0225509 A1 10/2005 Choi et al.
2006/0061521 A1 3/2006 Kim (Continued)

FOREIGN PATENT DOCUMENTS

EP 1990794 A1 11/2008

(Continued)

OTHER PUBLICATIONS

English language Abstract of JP 2004-191530, Jul. 8, 2004.

(Continued)

*Primary Examiner* — Alexander Eisen
*Assistant Examiner* — Robin Mishler
(74) *Attorney, Agent, or Firm* — Greenblum & Bernstein, P.L.C.

(57) ABSTRACT

A scan electrode driving circuit applies a rising ramp waveform voltage to scan electrodes (SCN1 to SCNn) to generate a first setup discharge in a first period within a setup period, applies a dropping ramp waveform voltage to the scan electrodes (SCN1 to SCNn) to generate a second setup discharge in a second period following the first period within the setup period, and applies a first positive rectangular waveform voltage (Vs), a negative rectangular waveform voltage (Va), a second positive rectangular waveform voltage (Vs) and a dropping ramp waveform voltage to the scan electrodes (SCN1 to SCNn) in a third period following the second period within the setup period. A data electrode driving circuit applies a positive rectangular waveform voltage (Vd) to data electrodes (D1 to Dm) in a period after application of the first positive rectangular waveform voltage (Vs) to the scan electrodes (SCN1 to SCNn) and before application of the negative rectangular waveform voltage (Va) to the scan electrodes (SCN1 to SCNn) in the third period.

8 Claims, 14 Drawing Sheets

U.S. PATENT DOCUMENTS

| | | | |
|---|---|---|---|
| 2006/0176246 | A1 | 8/2006 | Shoji et al. |
| 2007/0195051 | A1 | 8/2007 | Ikeda |
| 2007/0205964 | A1 | 9/2007 | Nagaki |
| 2007/0222902 | A1 | 9/2007 | Yamate |
| 2007/0268216 | A1 | 11/2007 | Arai et al. |
| 2008/0048937 | A1 | 2/2008 | Ogawa et al. |
| 2009/0058310 | A1 | 3/2009 | Arai et al. |
| 2009/0096719 | A1 | 4/2009 | Yoshihama et al. |
| 2009/0135098 | A1 | 5/2009 | Son et al. |
| 2009/0207161 | A1 | 8/2009 | Mima et al. |
| 2010/0066727 | A1 | 3/2010 | Maeda et al. |

FOREIGN PATENT DOCUMENTS

| | | | |
|---|---|---|---|
| JP | 11-265164 | | 9/1999 |
| JP | 11-265164 | A | 9/1999 |
| JP | 2000-242224 | A | 9/2000 |
| JP | 2004-191530 | A | 7/2004 |
| JP | 2004-326068 | | 11/2004 |
| JP | 2005-326612 | A | 11/2005 |
| JP | 2006-308626 | | 11/2006 |
| JP | 2006-308626 | A | 11/2006 |
| JP | 2008-26527 | | 2/2008 |
| JP | 2008-83137 | | 4/2008 |
| JP | 4613956 | | 10/2010 |
| JP | 4816729 | | 9/2011 |
| WO | 2007/099891 | A1 | 9/2007 |
| WO | WO2008/069271 | | 6/2008 |

OTHER PUBLICATIONS

English language Abstract of JP 2005-326612, Nov. 24, 2005.
English language Abstract of JP 11-265164, Sep. 28, 1999.
English language Abstract of JP 2006-308626, Nov. 9, 2006.
English language Abstract of JP 2000-242224, Sep. 8, 2000.
U.S. Appl. No. 12/513,692 to Maeda et al., which was filed on May 6, 2009.
Japan Office Action Decision to Grant a Patent in the corresponding Japanese Patent Application, mailed Dec. 6, 2011.

PLASMA DISPLAY DEVICE AND METHOD OF DRIVING THE SAME

TECHNICAL FIELD

The present invention relates to a plasma display device and a method of driving the same.

BACKGROUND ART

An AC surface discharge type panel that is typical as a plasma display panel (hereinafter abbreviated as a "panel") includes a number of discharge cells formed between a front plate and a back plate arranged so as to face each other. The front plate includes a plurality of pairs of display electrodes each composed of a pair of scan electrode and sustain electrode formed in parallel with one another on a front glass substrate, and includes a dielectric layer and a protective layer formed so as to cover the display electrodes. The back plate includes a plurality of data electrodes formed in parallel with one another on a back glass substrate, a dielectric layer that covers the data electrodes, a plurality of barrier ribs formed in parallel with the data electrodes, respectively, on the dielectric layer, and phosphor layers formed on a surface of the dielectric layer and side surfaces of the barrier ribs. Then, the front plate and the back plate are arranged to face each other such that the display electrodes intersect with the data electrodes in three dimensions, and then sealed. An inside discharge space is filled with a discharge gas. The discharge cells are formed at respective portions at which the display electrodes and the data electrodes face one another. In the panel having such a configuration, a gas discharge generates ultraviolet rays, which cause phosphors of R, G and B to be excited and to emit light in each of the discharge cells, so that color display is performed.

A general method of driving the panel is a sub-field method, in which one field period is divided into a plurality of sub-fields and the sub-fields causing light emission are combined to perform gray scale expression. Patent Document 1 discloses a new driving method, which is one method of the sub-field method, which improves a contrast ratio by reducing light emission that is not involved in gray scale expression to the minimum to suppress an increase in black luminance. Brief description will be made of the driving method.

Each sub-field has a setup period, a write period and a sustain period. Either one of a setup operation for all cells and a selective setup operation is performed in the setup period; the setup operation for all cells causes setup discharges in all the discharge cells that perform image display, and the selective setup operation selectively causes the setup discharges in the discharge cells in which sustain discharges have been performed in a immediately preceding sub-field.

In a setup period for all the cells, the setup discharges are simultaneously performed in all the discharge cells to erase the history of wall charges that have been stored on each discharge cell while wall charges necessary for a subsequent write operation are formed. In the subsequent write period, progressive-scan pulses are applied to the scan electrodes while write pulses corresponding to image signals to be displayed are applied to the data electrodes. This selectively induces write discharges between the scan electrodes and the data electrodes, causing the wall charges to be selectively formed. In the sustain period, sustain pulses are applied between the scan electrodes and the sustain electrodes a predetermined number of times corresponding to luminance weights, so that the discharge cells in which the wall charges have been formed by the write discharges are selectively discharged to cause light emission.

In discharge cells in which no sustain discharges have been induced, such as discharge cells that have been in black for several fields, however, shortage of priming causes a larger discharge time lag. Therefore, the setup discharges become unstable in the setup period for all the cells, causing excessive positive wall charges to be stored on the scan electrodes. The sustain discharges are induced in the discharge cells having the excessive positive wall charges stored on the scan electrodes, even though the write discharges have not been induced. These sustain discharges are visually recognized as bright spots, thus deteriorating black display quality.

Patent Document 2 describes a driving method that solves such a problem that the bright spots are visually recognized in the discharge cells having the excessive positive wall charges stored on the scan electrodes.

Brief description will be made of the driving method. An abnormal wall charges erase part in which a positive rectangular waveform voltage is applied to the scan electrodes and a negative rectangular waveform voltage is subsequently applied to the scan electrodes is provided in the setup period for all the cells or the selective setup period. Strong discharges are induced by the positive rectangular waveform voltage applied to the scan electrodes in the abnormal wall charges erase part in the discharge cells having the excessive positive wall charges stored on the scan electrodes. The wall charges are inverted by the strong discharges, and the erase discharges are induced by the negative rectangular waveform voltage subsequently applied to the scan electrodes, thus erasing the wall charges.

However, panels with a larger display screen size that meet recent demands for display devices with larger screens have a wider range of variation in the characteristics, such as the discharge start voltage and the discharge time lag, of the discharge cells arranged on the entire screen. This causes considerable variation in the magnitude of the erase discharges induced by the negative rectangular waveform voltage applied to the scan electrodes in the above-described abnormal wall charges erase part.

In this case, the wall charges are insufficiently erased in the discharge cells subjected to particularly weak erase discharges while the wall charges are inverted in the discharge cells subjected to particularly strong erase discharges.

Therefore, after application of the positive rectangular waveform voltage and then the negative rectangular waveform voltage to the scan electrodes, a positive voltage and a dropping ramp waveform voltage are applied in this order to the scan electrodes in the abnormal wall charges erase part.

Weak discharges are induced by the dropping ramp waveform voltage applied to the scan electrodes in the discharge cells of which wall charges have been insufficiently erased by the negative rectangular waveform voltage applied to the scan electrodes, so that the wall charges are adjusted to be normal. In the discharge cells of which wall charges are inverted by the negative rectangular waveform voltage applied to the scan electrodes, the discharges are induced by the positive voltage subsequently applied to the scan electrodes such that the wall charges are inverted, and the weak discharges are then induced by the dropping ramp waveform voltage applied to the scan electrodes, thus adjusting the wall charges to be normal.

As described above, the positive rectangular waveform voltage, the negative rectangular waveform voltage, the positive voltage and the dropping ramp waveform voltage are applied in this order to the scan electrodes in the abnormal wall charges erase part. This causes the wall charges to be erased by the negative rectangular waveform voltage applied to the scan electrodes in the discharge cells in which the excessive positive wall charges are stored on the scan electrodes. In the cells in which the wall charges have not been erased by the negative rectangular waveform voltage, the wall voltage is adjusted to be normal by the dropping ramp waveform voltage applied to the scan electrodes. In this manner, the state in which the excessive positive wall charges are stored on the scan electrodes is resolved, preventing generation of the bright spots.

[Patent Document 1] JP 2000-242224 A

[Patent Document 2] JP 2005-326612 A

DISCLOSURE OF THE INVENTION

Problems to be Solved by the Invention

In the discharge cells in which a discharge start voltage is significantly decreased by aged deterioration and the like, however, the discharges are induced by the positive rectangular waveform voltage applied to the scan electrodes, and the erase discharges are then induced by the negative rectangular waveform voltage subsequently applied to the scan electrodes, erasing the wall charges in the abnormal wall charges erase part. As described above, in the discharge cells in which the discharge start voltage is significantly decreased, the wall charges are erased in the abnormal wall charges erase part even though the excessive positive wall charges are not stored on the scan electrodes, so that a normal write operation cannot be performed.

An object of the present invention is to provide a plasma display device capable of performing the normal write operation and displaying images with excellent quality even in the discharge cells of which discharge start voltage is significantly decreased and a method of driving the same.

Means for Solving the Problems (1) According to an aspect of the present invention, a plasma display device that drives a plasma display panel including a plurality of discharge cells at intersections of a scan electrode and a sustain electrode with a plurality of data electrodes by a sub-field method in which one field period includes a plurality of sub-fields includes a scan electrode driving circuit that drives the scan electrode, a sustain electrode driving circuit that drives the sustain electrode and a data electrode driving circuit that drives the data electrodes, wherein at least one sub-field of the plurality of sub-fields includes a setup period in which wall charges of the plurality of discharge cells are adjusted such that write discharges can be performed, the scan electrode driving circuit applies a rising ramp waveform voltage to the scan electrode to generate first setup discharges between the scan electrode as an anode and the sustain electrode and the data electrodes as cathodes in a first period within the setup period, applies a dropping ramp waveform voltage to the scan electrode to generate second setup discharges between the scan electrode as a cathode and the sustain electrode and the data electrodes as anodes in a second period following the first period within the setup period, and applies a positive rectangular waveform voltage, a negative rectangular waveform voltage and a dropping ramp waveform voltage to the scan electrode in a third period following the second period within the setup period, and the data electrode driving circuit applies a positive rectangular waveform voltage to the data electrodes in a period between application of the positive rectangular waveform voltage to the scan electrode and application of the negative rectangular waveform voltage to the scan electrode in the third period.

In the plasma display device, the at least one sub-field of the plurality of sub-fields includes the setup period in which the wall charges of the plurality of discharge cells are adjusted such that the write discharges can be performed.

In the first period within the setup period, the rising ramp waveform voltage is applied to the scan electrode by the scan electrode driving circuit to generate the first setup discharges between the scan electrode as the anode and the sustain electrode and the data electrodes as the cathodes. This causes negative wall charges to be stored on the scan electrode and positive wall charges to be stored on the sustain electrode and the data electrodes.

In the second period following the first period within the setup period, the dropping ramp waveform voltage is applied to the scan electrode by the scan electrode driving circuit to generate the second setup discharges between the scan electrode as the cathode and the sustain electrode and the data electrodes as the anodes. This reduces the wall charges on the scan electrode and the wall charges on the sustain electrode, and adjusts the wall charges on the data electrodes to a value suitable for a write operation.

Here, the voltage of the discharge cells significantly exceeds a discharge start voltage at the time of generation of the discharges in the first period of the setup period when a discharge time lag is large, so that strong discharges, not weak discharges, are generated. Alternatively, strong discharges with the data electrodes as the cathodes are generated first. Then, the excessive negative wall charges are stored on the scan electrode. This causes the strong discharges to be again generated in the discharge cells in the second period of the setup period. This results in excessive positive wall charges stored on the scan electrode.

In the third period following the second period within the setup period, the positive rectangular waveform voltage, the negative rectangular waveform voltage and the dropping ramp waveform voltage are applied to the scan electrode by the scan electrode driving circuit. In addition, the positive rectangular waveform voltage is applied to the data electrodes by the data electrode driving circuit in the period between the application of the positive rectangular waveform voltage to the scan electrode and the application of the negative rectangular waveform voltage to the scan electrode in the third period.

During this period, the application of the positive rectangular waveform voltage to the scan electrode causes the voltage of the discharge cells to exceed the discharge start voltage in the discharge cells having the excessive positive wall charges stored on the scan electrode and the discharge cells of which discharge start voltage is decreased, thus generating the strong discharges to invert the wall charges on the scan electrode. In the discharge cells of which discharge start voltage is decreased, the discharges are generated by the application of the positive rectangular waveform voltage to the data electrodes. These discharges seem as if the erase discharges are forcibly terminated in the middle, and cause the wall charges in the discharge cells to be adjusted such that the write operation can be normally performed in a write period. The discharge cells that are discharged by the positive rectangular waveform voltage applied to the data electrodes are not discharged by the negative rectangular waveform voltage applied to the scan electrode and the dropping ramp waveform voltage subsequently applied to the scan electrode. The discharge cells in which the excessive wall charges are stored are discharged by the positive rectangular waveform voltage applied to the data electrodes or the negative rectangular waveform voltage applied to the scan electrode. When the discharge cells are discharged by the positive rectangular waveform voltage applied to the data electrodes, the discharges seem as if the erase discharges are forcibly terminated in the middle, but the state in which the excessive wall charges are stored is resolved. Accordingly, the discharge cells are not discharged by the negative rectangular waveform voltage, the positive rectangular waveform voltage and the dropping ramp waveform voltage applied to the scan electrode, preventing the wall charges from being erased.

The discharge cells in which the erase discharges have been generated by the negative rectangular waveform voltage applied to the scan electrode are brought into any of a state in which the wall charges have been erased, a state in which the wall charges have been insufficiently erased by weak erase discharges and a state in which the wall charges have been inverted by strong erase discharges. The discharge cells in the state in which the wall charges have been erased are not discharged by the positive rectangular waveform voltage and the dropping ramp waveform voltage applied to the scan electrode. The discharge cells in the state in which the wall charges have been insufficiently erased are not discharged by the positive rectangular waveform voltage applied to the scan electrode but subjected to weak discharges caused by the dropping ramp waveform voltage applied to the scan electrode, thus causing the wall charges to be adjusted such that normal writing can be performed. The discharge cells in the state in which the wall charges have been inverted are discharged by the positive rectangular waveform voltage applied to the scan electrode to cause the wall charges to be again inverted, and subjected to the weak discharges caused by the dropping ramp waveform voltage applied to the scan electrode, thus causing the wall charges to be adjusted such that the normal writing can be performed.

As described above, since the wall charges are not erased in the third period of the setup period in the discharge cells of which discharge start voltage is decreased, the normal write operation is performed in the subsequent write period. This allows display of images with excellent quality.

(2) The data electrode driving circuit may sequentially apply two or more positive rectangular waveform voltages to the data electrodes in the third period.

In this case, the wall charges are prevented from being erased in the third period of the setup period even in the case of a large discharge time lag of the discharge cells of which discharge start voltage is decreased. Accordingly, the normal write operation is performed.

(3) The data electrode driving circuit may sequentially apply two or more positive rectangular waveform voltages to the data electrodes in the third period, and a voltage application period of the rectangular waveform voltage first applied to the data electrodes may be the shortest among voltage application periods of the plurality of rectangular waveform voltages applied to the data electrodes.

In this case, the discharge cell with a small discharge time lag among the discharge cells of which discharge start voltage is decreased can be discharged by the rectangular waveform voltage that is first applied. Thus, the wall charges are prevented from being erased in the third period of the setup period even when the discharge cells of which discharge start voltage is decreased have different discharge time lags. Accordingly, the normal write operation is performed.

(4) According to another aspect of the present invention, a plasma display device that drives a plasma display panel including a plurality of discharge cells at intersections of a scan electrode and a sustain electrode with a plurality of data electrodes by a sub-field method in which one field period includes a plurality of sub-fields includes a scan electrode driving circuit that drives the scan electrode, a sustain electrode driving circuit that drives the sustain electrode and a data electrode driving circuit that drives the data electrodes, wherein at least one sub-field of the plurality of sub-fields includes a setup period in which wall charges of the plurality of discharge cells are adjusted such that write discharges can be performed, the scan electrode driving circuit applies a dropping ramp waveform voltage to the scan electrode to generate setup discharges between the scan electrode as a cathode and the sustain electrode and the data electrodes as anodes in a first period within the setup period, and applies a positive rectangular waveform voltage, a negative rectangular waveform voltage and a dropping ramp waveform voltage to the scan electrode in a second period following the first period within the setup period, and the data electrode driving circuit applies a positive rectangular waveform voltage to the data electrodes in a period between application of the positive rectangular waveform voltage to the scan electrode and application of the negative rectangular waveform voltage to the scan electrode in the second period.

In the plasma display device, the at least one sub-field of the plurality of sub-fields includes the setup period in which the wall charges of the plurality of discharge cells are adjusted such that the write discharges can be performed.

In the first period within the setup period, the dropping ramp waveform voltage is applied to the scan electrode by the scan electrode driving circuit to generate the setup discharges between the scan electrode as the cathode and the sustain electrode and the data electrodes as the anodes. This reduces the wall charges on the scan electrode and the wall charges on the sustain electrode, and adjusts the wall charges on the data electrodes to a value suitable for a write operation in discharge cells in which sustain discharges have been performed in a sustain period of a preceding sub-field.

Here, the voltage of the discharge cells significantly exceeds a discharge start voltage at the time of generation of the discharges in the first period of the setup period when a discharge time lag is large, so that strong discharges, not weak discharges, are generated. Alternatively, strong discharges with the data electrodes as the cathodes are generated first. As a result, the excessive positive wall charges are stored on the scan electrode.

In the second period within the setup period, the positive rectangular waveform voltage, the negative rectangular waveform voltage and the dropping ramp waveform voltage are applied to the scan electrode by the scan electrode driving circuit. In addition, the positive rectangular waveform voltage is applied to the data electrodes by the data electrode driving circuit in the period between the application of the positive rectangular waveform voltage to the scan electrode and the application of the negative rectangular waveform voltage to the scan electrode in the second period.

During this period, the application of the positive rectangular waveform voltage to the scan electrode causes the voltage of the discharge cells to exceed the discharge start voltage in the discharge cells having the excessive positive wall charges stored on the scan electrode and the discharge cells of which discharge start voltage is decreased, thus generating the strong discharges to invert the wall charges on the scan electrode. In the discharge cells of which discharge start voltage is decreased, the discharges are generated by the application of the positive rectangular waveform voltage to the data electrodes. These discharges seem as if the erase discharges are forcibly terminated in the middle and cause the wall charges in the discharge cells to be adjusted such that the write operation can be normally performed in the write period. The discharge cells that are discharged by the positive rectangular waveform voltage applied to the data electrodes are not discharged by the negative rectangular waveform voltage applied to the scan electrode. The discharge cells in which the excessive wall charges are stored are discharged by the positive rectangular waveform voltage applied to the data electrodes or the negative rectangular waveform voltage applied to the scan electrode. When the discharge cells are discharged by the positive rectangular waveform voltage applied to the data electrodes, the discharges seem as if the erase discharges are forcibly terminated in the middle, but the state in which the excessive wall charges are stored is resolved. Accordingly, the discharge cells are not discharged by the negative rectangular waveform voltage, the positive rectangular waveform voltage and the dropping ramp waveform voltage applied to the scan electrode, preventing the wall charges from being erased.

The discharge cells in which the erase discharges have been generated by the negative rectangular waveform voltage applied to the scan electrode are brought into any of a state in which the wall charges have been erased, a state in which the wall charges have been insufficiently erased by weak erase discharges and a state in which the wall charges have been inverted by strong erase discharges. The discharge cells in the state in which the wall charges have been erased are not discharged by the positive rectangular waveform voltage and the dropping ramp waveform voltage applied to the scan electrode. The discharge cells in the state in which the wall charges have been insufficiently erased are not discharged by the positive rectangular waveform voltage applied to the scan electrode but subjected to weak discharges caused by the dropping ramp waveform voltage applied to the scan electrode, thus causing the wall charges to be adjusted such that normal writing can be performed. The discharge cells in the state in which the wall charges have been inverted are discharged by the positive rectangular waveform voltage applied to the scan electrode to cause the wall charges to be again inverted, and subjected to the weak discharges caused by the dropping ramp waveform voltage applied to the scan electrode, thus causing the wall charges to be adjusted such that the normal writing can be performed.

As described above, since the wall charges are not erased in the second period of the setup period in the discharge cells of which discharge start voltage is decreased, the normal write operation is performed in the subsequent write period. This allows display of images with excellent quality.

(5) According to still another aspect of the present invention, a method of driving a plasma display device that drives a plasma display panel including a plurality of discharge cells at intersections of a scan electrode and a sustain electrode with a plurality of data electrodes by a sub-field method in which one field period includes a plurality of sub-fields includes the steps of driving the scan electrode, driving the sustain electrode, and driving the data electrodes, wherein at least one sub-field of the plurality of sub-fields includes a setup period in which wall charges of the plurality of discharge cells are adjusted such that write discharges can be performed, the step of driving the scan electrode includes the steps of applying a rising ramp waveform voltage to the scan electrode to generate first setup discharges between the scan electrode as an anode and the sustain electrode and the data electrodes as cathodes in a first period within the setup period, applying a dropping ramp waveform voltage to the scan electrode to generate second setup discharges between the scan electrode as a cathode and the sustain electrode and the data electrodes as anodes in a second period following the first period within the setup period, and applying a positive rectangular waveform voltage, a negative rectangular waveform voltage and a dropping ramp waveform voltage to the scan electrode in a third period following the second period within the setup period, and the step of driving the data electrodes includes the step of applying a positive rectangular waveform voltage to the data electrodes in a period between application of the positive rectangular waveform voltage to the scan electrode and application of the negative rectangular waveform voltage to the scan electrode in the third period.

In the method of driving the plasma display device, the at least one sub-field of the plurality of sub-fields includes the setup period in which the wall charges of the plurality of discharge cells are adjusted such that the write discharges can be performed.

In the first period within the setup period, the rising ramp waveform voltage is applied to the scan electrode to generate the first setup discharges between the scan electrode as the anode and the sustain electrode and the data electrodes as the cathodes. This causes negative wall charges to be stored on the scan electrode and positive wall charges to be stored on the sustain electrode and the data electrodes.

In the second period following the first period within the setup period, the dropping ramp waveform voltage is applied to the scan electrode to generate the second setup discharges between the scan electrode as the cathode and the sustain electrode and the data electrodes as the anodes. This reduces the wall charges on the scan electrode and the wall charges on the sustain electrode, and adjusts the wall charges on the data electrodes to a value suitable for a write operation.

Here, the voltage of the discharge cells significantly exceeds a discharge start voltage at the time of generation of the discharges in the first period of the setup period when a discharge time lag is large, so that strong discharges, not weak discharges, are generated. Alternatively, strong discharges with the data electrodes as the cathodes are generated first. Then, the excessive negative wall charges are stored on the scan electrode. This causes the strong discharges to be again generated in the discharge cells in the second period of the setup period. This results in excessive positive wall charges stored on the scan electrode.

In the third period following the second period within the setup period, the positive rectangular waveform voltage, the negative rectangular waveform voltage and the dropping ramp waveform voltage are applied to the scan electrode. In addition, the positive rectangular waveform voltage is applied to the data electrodes in the period between the application of the positive rectangular waveform voltage to the scan electrode and the application of the negative rectangular waveform voltage to the scan electrode in the third period.

During this period, the application of the positive rectangular waveform voltage to the scan electrode causes the voltage of the discharge cell to exceed the discharge start voltage in the discharge cells having the excessive positive wall charges stored on the scan electrode and the discharge cells of which discharge start voltage is decreased, thus generating the strong discharges to invert the wall charges on the scan electrode. In the discharge cells of which discharge start voltage is decreased, the discharges are generated by the application of the positive rectangular waveform voltage to the data electrodes. These discharges seem as if the erase discharges are forcibly terminated in the middle and cause the wall charges in the discharge cells to be adjusted such that the write operation can be normally performed in the write period. The discharge cells that are discharged by the positive rectangular waveform voltage applied to the data electrodes are not discharged by the negative rectangular waveform voltage applied to the scan electrode. The discharge cells in which the excessive wall charges are stored are discharged by the positive rectangular waveform voltage applied to the data electrodes or the negative rectangular waveform voltage applied to the scan electrode. When the discharge cells are discharged by the positive rectangular waveform voltage applied to the data electrodes, the discharges seem as if the erase discharges are forcibly terminated in the middle, but the state in which the excessive wall charges are stored is resolved. Accordingly, the discharge cells are not discharged by the negative rectangular waveform voltage, the positive rectangular waveform voltage and the dropping ramp waveform voltage applied to the scan electrode, preventing the wall charges from being erased.

The discharge cells in which the erase discharges have been generated by the negative rectangular waveform voltage applied to the scan electrode are brought into any of a state in which the wall charges have been erased, a state in which the wall charges have been insufficiently erased by weak erase discharges and a state in which the wall charges have been inverted by strong erase discharges. The discharge cells in the state in which the wall charges have been erased are not discharged by the positive rectangular waveform voltage and the dropping ramp waveform voltage applied to the scan electrode. The discharge cells in the state in which the wall charges have been insufficiently erased are not discharged by the positive rectangular waveform voltage applied to the scan electrode but subjected to weak discharges caused by the dropping ramp waveform voltage applied to the scan electrode, thus causing the wall charges to be adjusted such that normal writing can be performed. The discharge cells in the state in which the wall charges have been inverted are discharged by the positive rectangular waveform voltage applied to the scan electrode to cause the wall charges to be again inverted, and subjected to the weak discharges caused by the dropping ramp waveform voltage applied to the scan electrode, thus causing the wall charges to be adjusted such that the normal writing can be performed.

As described above, since the wall charges are not erased in the third period of the setup period in the discharge cells of which discharge start voltage is decreased, the normal write operation is performed in the subsequent write period. This allows display of images with excellent quality.

(6) The step of driving the data electrodes may include the step of sequentially applying two or more positive rectangular waveform voltages to the data electrodes in the third period.

In this case, the wall charges are prevented from being erased in the third period of the setup period even in the case of the large discharge time lag of the discharge cells of which discharge start voltage is decreased. Accordingly, the normal write operation is performed.

(7) The step of driving the data electrodes may include the step of sequentially applying two or more positive rectangular waveform voltages to the data electrodes in the third period, wherein a voltage application period of the rectangular waveform voltage first applied to the data electrodes is the shortest among voltage application periods of the plurality of rectangular waveform voltages applied to the data electrodes.

In this case, the discharge cell having the small discharge time lag among the discharge cells of which discharge start voltage is decreased can be discharged by the rectangular waveform voltage that is first applied. Thus, the wall charges are prevented from being erased in the third period of the setup period even when the discharge cells of which discharge start voltage is decreased have different discharge time lags. Accordingly, the normal write operation is performed.

(8) According to yet another aspect of the present invention, a method of driving a plasma display device that drives a plasma display panel including a plurality of discharge cells at intersections of a scan electrode and a sustain electrode with a plurality of data electrodes by a sub-field method in which one field period includes a plurality of sub-fields includes the steps of driving the scan electrode, driving the sustain electrode, and driving the data electrodes, wherein at least one sub-field of the plurality of sub-fields includes a setup period in which wall charges of the plurality of discharge cells are adjusted such that write discharges can be performed, the step of driving the scan electrode includes the steps of applying a dropping ramp waveform voltage to the scan electrode to generate setup discharges between the scan electrode as a cathode and the sustain electrode and the data electrodes as anodes in a first period in the setup period, and applying a positive rectangular waveform voltage, a negative rectangular waveform voltage and a dropping ramp waveform voltage to the scan electrode in a second period following the first period in the setup period, and the step of driving the data electrodes includes the step of applying a positive rectangular waveform voltage to the data electrodes in a period between application of the positive rectangular waveform voltage to the scan electrode and application of the negative rectangular waveform voltage to the scan electrode in the second period.

In the method of driving the plasma display device, the at least one sub-field of the plurality of sub-fields includes the setup period in which the wall charges of the plurality of discharge cells are adjusted such that the write discharges can be performed.

In the first period within the setup period, the dropping ramp waveform voltage is applied to the scan electrode to generate the setup discharges between the scan electrode as the cathode and the sustain electrode and the data electrodes as the anodes. This reduces the wall charges on the scan electrode and the wall charges on the sustain electrode, and adjusts the wall charges on the data electrodes to a value suitable for a write operation in the discharge cells in which sustain discharges have been performed in a sustain period of a preceding sub-field.

Here, the voltage of the discharge cells significantly exceeds a discharge start voltage at the time of generation of the discharges in the first period of the setup period when a discharge time lag is large, so that strong discharges, not weak discharges, are generated. Alternatively, strong discharges with the data electrodes as the cathodes are generated first. As a result, the excessive positive wall charges are stored on the scan electrode.

In the second period within the setup period, the positive rectangular waveform voltage, the negative rectangular waveform voltage and the dropping ramp waveform voltage are applied to the scan electrode. In addition, the positive rectangular waveform voltage is applied to the data electrodes in the period between the application of the positive rectangular waveform voltage to the scan electrode and the application of the negative rectangular waveform voltage to the scan electrode in the second period.

During this period, the application of the positive rectangular waveform voltage to the scan electrode causes the voltage of the discharge cells to exceed the discharge start voltage in the discharge cells having the excessive positive wall charges stored on the scan electrode and the discharge cells of which discharge start voltage is decreased, thus generating the strong discharges to invert the wall charges on the scan electrode. In the discharge cells of which discharge start voltage is decreased, the discharges are generated by the application of the positive rectangular waveform voltage to the data electrodes. These discharges seem as if the erase discharges are forcibly terminated in the middle and cause the wall charges in the discharge cells to be adjusted such that the write operation can be normally performed in the write period. The discharge cells that are discharged by the positive rectangular waveform voltage applied to the data electrodes are not discharged by the negative rectangular waveform voltage applied to the scan electrode. The discharge cells in which the excessive wall charges are stored are discharged by the positive rectangular waveform voltage applied to the data electrodes or the negative rectangular waveform voltage applied to the scan electrode. When the discharge cells are discharged by the positive rectangular waveform voltage applied to the data electrodes, the discharges seem as if the erase discharges are forcibly terminated in the middle, but the state in which the excessive wall charges are stored is resolved. Accordingly, the discharge cells are not discharged by the negative rectangular waveform voltage, the positive rectangular waveform voltage and the dropping ramp waveform voltage applied to the scan electrode, preventing the wall charges from being erased.

The discharge cells in which the erase discharges have been generated by the negative rectangular waveform voltage applied to the scan electrode are brought into any of a state in which the wall charges have been erased, a state in which the wall charges have been insufficiently erased by weak erase discharges and a state in which the wall charges have been inverted by strong erase discharges. The discharge cells in the state in which the wall charges have been erased are not discharged by the positive rectangular waveform voltage and the dropping ramp waveform voltage applied to the scan electrode. The discharge cells in the state in which the wall charges have been insufficiently erased are not discharged by the positive rectangular waveform voltage applied to the scan electrode but subjected to the weak discharges caused by the dropping ramp waveform voltage applied to the scan electrode, thus causing the wall charges to be adjusted such that normal writing can be performed. The discharge cells in which the wall charges have been inverted are discharged by the positive rectangular waveform voltage applied to the scan electrode to cause the wall charges to be again inverted, and subjected to the weak discharges caused by the dropping ramp waveform voltage applied to the scan electrode, thus causing the wall charges to be adjusted such that the normal writing can be performed.

As described above, since the wall charges are not erased in the second period of the setup period in the discharge cells of which discharge start voltage is decreased, the normal write operation is performed in the subsequent write period. This allows display of images with excellent quality.

Effects of the Invention

According to the present invention, since wall charges are not erased in the last period of a setup period in a discharge cell of which discharge start voltage is decreased, a normal write operation is performed in a subsequent write period. This enables display of images with excellent quality.

BEST MODE FOR CARRYING OUT THE INVENTION

Figure 1:
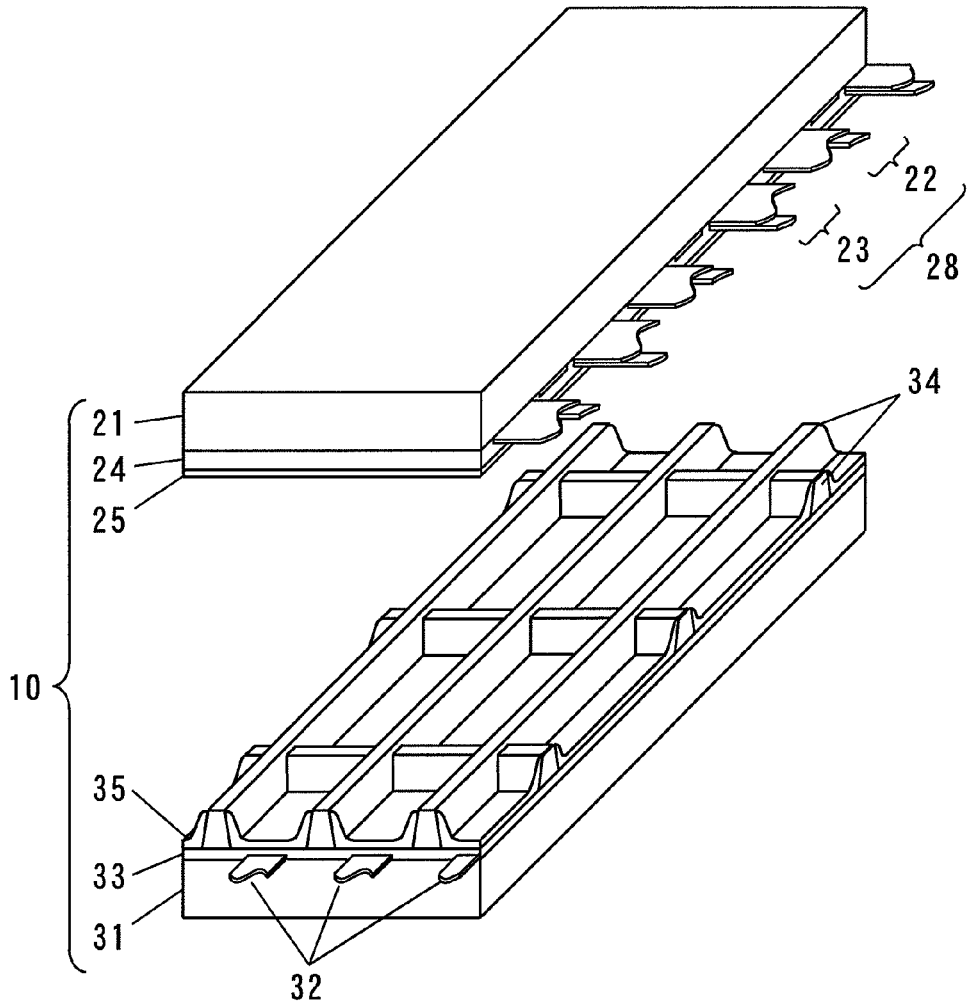
FIG. 1 is a perspective view showing principal parts of a panel employed in a first embodiment of the present invention.

The embodiments of the present invention will be described in detail referring to the drawings. The embodiments below describe a method of driving a panel.

(1) First Embodiment

FIG. 1 is an exploded perspective view showing the configuration of a panel 10 in a first embodiment of the present invention. A plurality of display electrode pairs 28 each composed of a scan electrode 22 and a sustain electrode 23 are formed on a glass-made front plate 21. A dielectric layer 24 is formed so as to cover the scan electrodes 22 and the sustain electrodes 23, and a protective layer 25 is formed on the dielectric layer 24. A plurality of data electrodes 32 are formed on a back plate 31, a dielectric layer 33 is formed so as to cover the data electrodes 32, and barrier ribs 34 are formed in a shape of a number sign on the dielectric layer 33. Then, phosphor layers 35 that emit light of red (R), green (G) and blue (B) are provided on side surfaces of the barrier ribs 34 and on the dielectric layer 33.

The front plate 21 and the back plate 31 are arranged so as to be opposite to each other with a micro-space for discharges sandwiched therebetween such that the display electrode pairs 28 and the data electrodes 32 intersect with one another, and the periphery is sealed with a sealing material such as a glass frit. The space for discharges is filled with a mixed gas of neon and xenon, for example, as a discharge gas. The space for discharges is separated into a plurality of sections by the barrier ribs 34, and discharge cells are formed at intersections of the display electrode pairs 28 and the data electrodes 32.

These discharge cells are discharged to emit light, thereby causing images to be displayed.

Note that the configuration of the panel is not limited to the configuration described in the foregoing. A configuration including the barrier ribs in a striped shape may be employed, for example.

Figure 2:
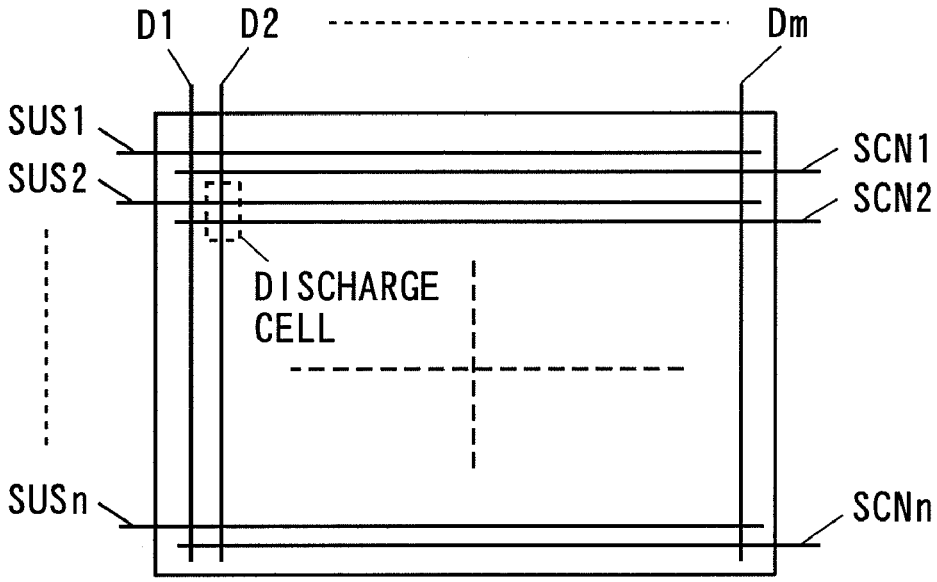
FIG. 2 is a diagram showing an arrangement of electrodes of the panel in the first embodiment of the present invention.

FIG. 2 is a diagram showing an arrangement of the electrodes of the panel in the embodiment of the present invention. N scan electrodes SCN1 to SCNn (the scan electrodes 4 of FIG. 1) and n sustain electrodes SUS1 to SUSn (the sustain electrodes 5 of FIG. 1) are alternately arranged along a row direction, and m data electrodes D1 to Dm (the data electrodes 9 of FIG. 1) are arranged along a column direction. Thus, a discharge cell is formed at an intersection of a pair of scan electrode SCNi and sustain electrode SUSi (i=1 to n) with one data electrode Dj (j=1 to m). Accordingly, m×n discharge cells are formed in the discharge space.

Figure 3:
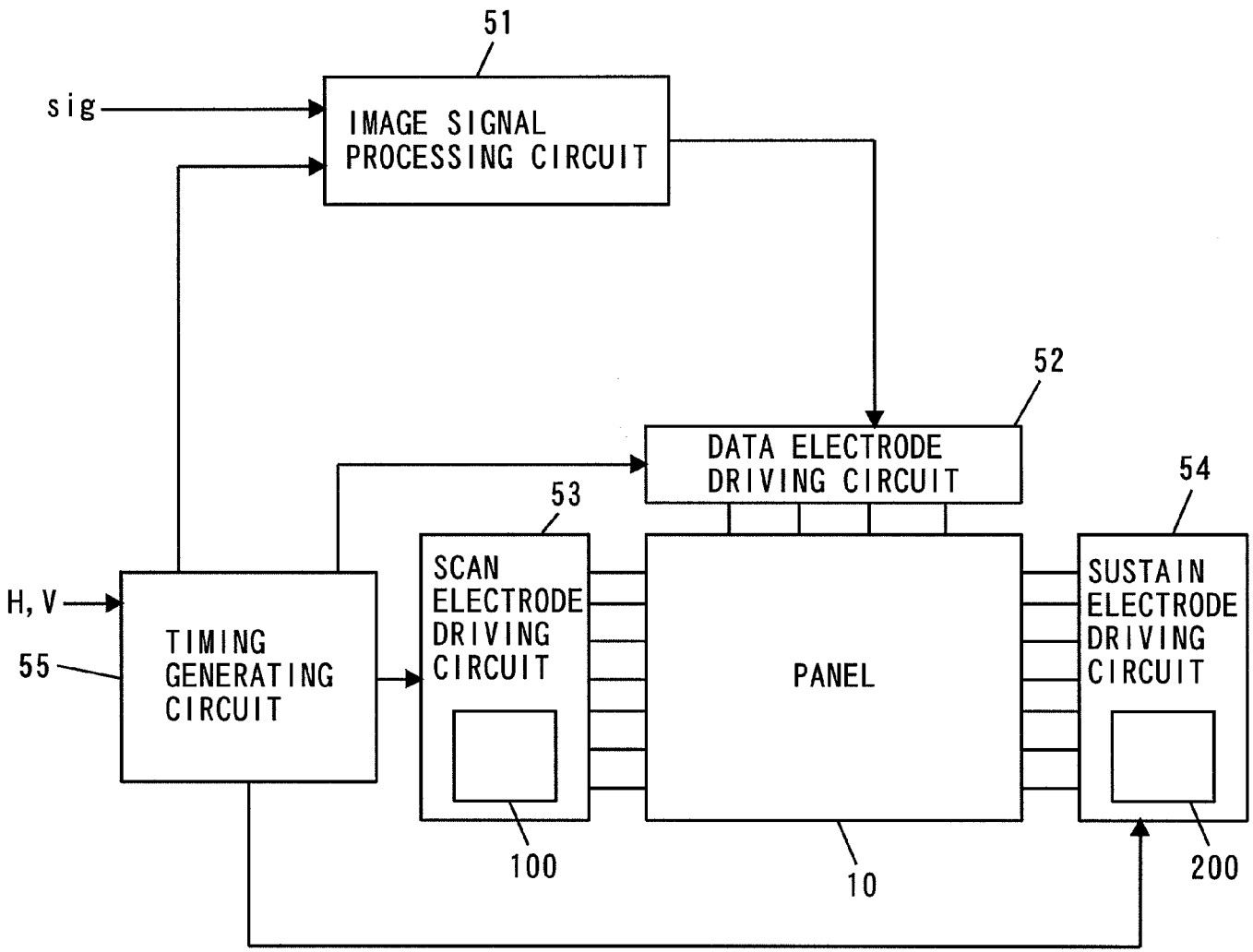
FIG. 3 is a structural diagram of a plasma display device employing a method of driving the same panel.

FIG. 3 is a circuit block diagram of a plasma display device 1 in the first embodiment of the present invention. The plasma display device 1 includes the panel 10, an image signal processing circuit 51, a data electrode driving circuit 52, a scan electrode driving circuit 53, a sustain electrode driving circuit 54, a timing generating circuit 55 and a power supply circuit (not shown) that supplies necessary power to each circuit block. The image signal processing circuit 51 converts an input image signal sig into image data indicating emission/non-emission for each sub-field. The data electrode driving circuit 52 converts the image data for each sub-field into signals corresponding to the data electrodes D1 to Dm, respectively, and drives the data electrodes D1 to Dm.

The timing generating circuit 55 generates various timing signals that control the operations of the respective circuit blocks based on a horizontal synchronizing signal H and a vertical synchronizing signal V, and supplies the timing signals to the respective circuit blocks. The scan electrode driving circuit 53 includes a sustain pulse generating circuit 100 for generating sustain pulses applied to the scan electrodes SCN1 to SCNn in the sustain period, and drives each of the scan electrodes SCN1 to SCNn based on the timing signals. The sustain electrode driving circuit 54 includes a circuit that applies a voltage Ve1 to the sustain electrodes SUS1 to SUSn in the setup period and a sustain pulse generating circuit 200 for generating sustain pulses applied to the sustain electrodes SUS1 to SUSn in the sustain period, and drives the sustain electrodes SUS1 to SUSn based on the timing signals.

Next, description is made of driving waveforms for driving the panel and the operations thereof. In the embodiments, one field is divided into ten sub-fields (a first SF, a second SF, . . . and a tenth SF), and the sub-fields have luminance weights of 1, 2, 3, 6, 11, 18, 30, 44, 60 and 80, respectively. In this manner, a field is configured such that the sub-fields arranged later have larger luminance weights.

Figure 4:
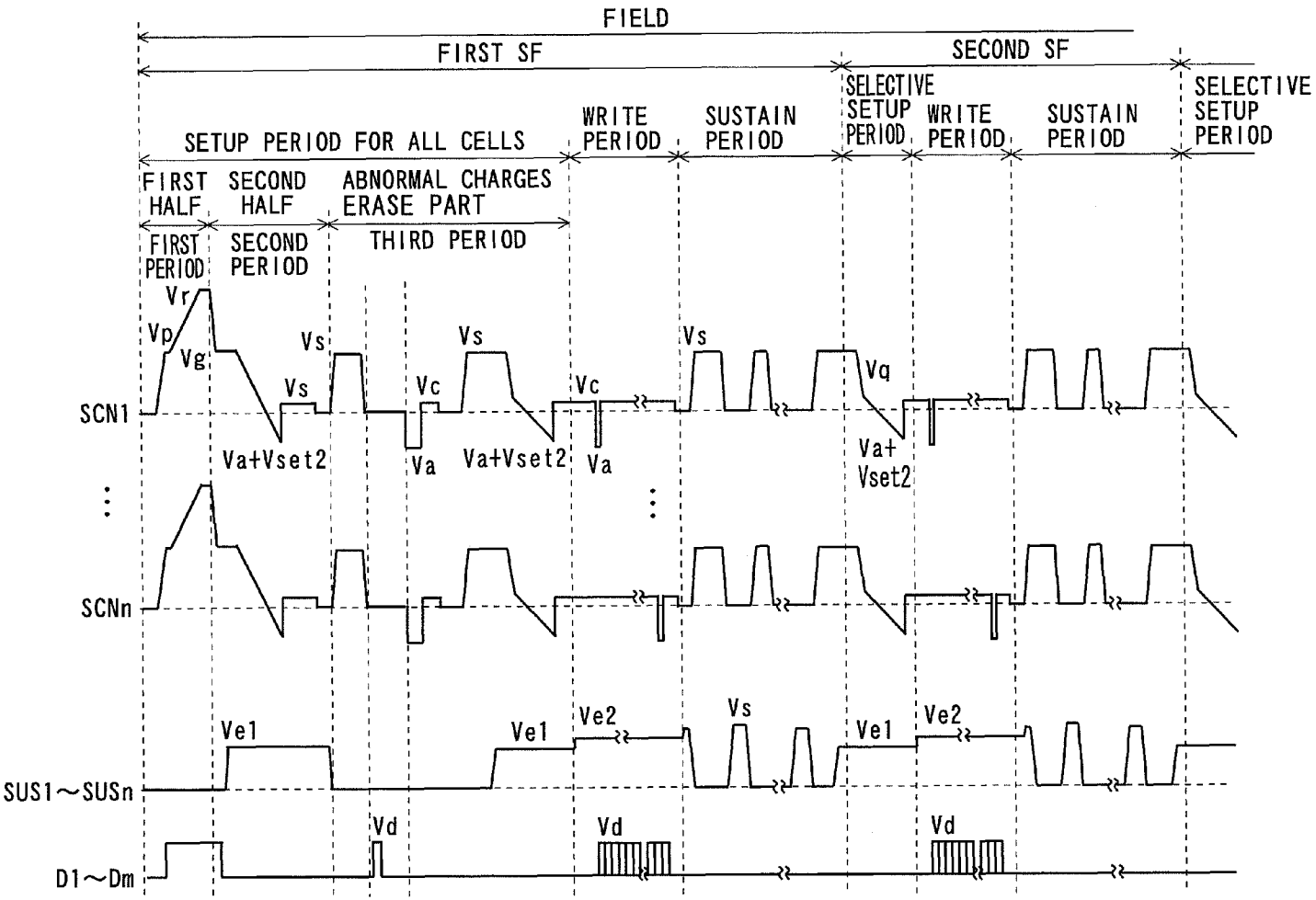
FIG. 4 is a diagram showing driving waveforms applied to the respective electrodes of the same panel.

FIG. 4 is a diagram showing the driving waveforms applied to the respective electrodes of the panel in the first embodiment of the present invention, and shows the driving waveforms in the sub-field having a setup period in which a setup operation for all cells is performed (hereinafter abbreviated as the "setup sub-field for all cells") and the sub-field having a setup period in which a selective setup operation is performed (hereinafter abbreviated as the "selective setup sub-field"). FIG. 4 is the driving waveform diagram when the first SF is the setup sub-field for all the cells and the second SF is the selective setup sub-field.

First, the driving waveforms in the setup sub-field for all the cells and the operations thereof will be described. The setup period for all the cells is divided into three periods: the first half (a first period), the second half (a second period) and an abnormal charges erase part (a third period) when described.

In the first half of the setup period, the sustain electrodes SUS1 to SUSn are held at 0 (V), the data electrodes D1 to Dm are held at a positive voltage Vd (V), and a rising ramp waveform voltage gradually rising from a voltage Vp (V) that is not more than a discharge start voltage to a voltage Vr (V) that exceeds the discharge start voltage is applied to the scan electrodes SCN1 to SCNn. This generates weak setup discharges with the scan electrodes SCN1 to SCNn as anodes and the sustain electrodes SUS1 to SUSn and the data electrodes D1 to Dm as cathodes. First weak setup discharges are generated in all the discharge cells in this manner, so that a negative wall voltage is stored on the scan electrodes SCN1 to SNCn while positive wall voltages are stored on the sustain electrodes SUS1 to SUSn and the data electrodes D1 to Dm. Here, the wall voltage on the electrode is a voltage caused by wall charges stored on the dielectric layer or the phosphor layer covering the electrode.

In the second half of the setup period, the sustain electrodes SUS1 to SUSn are held at a positive voltage Ve1 (V), the data electrodes D1 to Dm are held at 0 (V), and a dropping ramp waveform voltage gradually dropping from a voltage Vg (V) to a voltage (Va+Vset2) (V) is applied to the scan electrodes SCN1 to SCNn. This induces second weak setup discharges in all the discharge cells with the scan electrodes SCN1 to SCNn as the cathodes and the sustain electrodes SUS1 to SUSn and the data electrodes D1 to Dm as the anodes, so that the wall voltage on the scan electrodes SCN1 to SCNn and the wall voltage on the sustain electrodes SUS1 to SUSn are weakened, and the wall voltage on the data electrodes D1 to Dm are adjusted to a value suitable for a write operation. As described above, the setup operation in the setup sub-field for all the cells is the setup operation for all the cells that generates the setup discharges in all the discharge cells.

When shortage of priming or the like causes a larger discharge time lag, however, excessive positive wall charges are stored on the scan electrodes SCN1 to SCNn in the first half and the second half of the setup period for all the cells. The reason will be described.

When the discharge cells are discharged by the rising ramp waveform voltage gradually rising and applied to the scan electrodes SCN1 to SCNn in the first half of the setup period, the voltage of the discharge cells significantly exceeds the discharge start voltage at the time of generation of the discharges in the case of the large discharge time lag, resulting in generation of strong discharges, not the weak discharges. Alternatively, strong discharges with the data electrodes D1 to Dm as the cathodes are generated first. Thus, excessive negative wall charges are stored on the scan electrodes SCN1 to SCNn. This again generates the strong discharges in the discharge cells during application of the dropping ramp waveform voltage to the scan electrodes SCN1 to SCNn, so that the excessive positive wall charges are stored on the scan electrodes SCN1 to SCNn in the second half of the setup period.

In the abnormal charges erase part in the setup period, the sustain electrodes SUS1 to SUSn are returned to 0 (V). After a first positive voltage Vs (V) that does not reach the discharge start voltage is applied to the scan electrodes SCN1 to SCNn for 5 to 20 μs, the positive voltage Vd (V) is applied to the data electrodes D1 to Dm for 100 ns to 1 μs, and a negative voltage Va (V) is subsequently applied to the scan electrodes SCN1 to SCNn for such a short period of time as not more than 5 μs. Furthermore, a second positive voltage Vs (V) is applied to the scan electrodes SCN1 to SCNn, and a ramp waveform voltage gradually dropping toward a voltage (Va+Vset2) (V) is then applied to the scan electrodes SCN1 to SCNn. During this period, the discharges are not generated in the discharge cells of which discharge start voltage is not decreased among the discharge cells in which the setup discharges have been stably performed, and the wall voltage is held in a state in the second half of the setup period. In the discharge cells in which the abnormal positive wall charges are stored on the scan electrodes SCN1 to SCNn and the discharge cells of which discharge start voltage is decreased, however, application of the voltage Vs (V) to the scan electrodes SCN1 to SCNn causes the voltage of the discharges cells to exceed the discharge start voltage, thus generating the strong discharges to invert the wall voltage on the scan electrodes SCN1 to SCNn. In the discharge cells of which discharge start voltage is decreased among the discharge cells in which the abnormal wall charges are stored and the discharge cells of which discharge start voltage is decreased, the discharges are generated by application of the positive voltage Vd (V) to the data electrodes D1 to Dm. These discharges seem as if erase discharges are forcibly terminated in the middle since the positive voltage Vd (V) is applied to the data electrodes D1 to Dm for a very short period of time.

These discharges adjust the wall charges in the discharge cells such that the write operation can be normally performed in the write period. The discharge cells that are discharged by the positive voltage Vd (V) applied to the data electrodes D1 to Dm are not discharged by the negative voltage Va (V) applied to the scan electrodes SCN1 to SCNn, the second positive voltage Vs (V) applied to the scan electrodes SCN1 to SCNn and the ramp waveform voltage gradually dropping toward the voltage (Va+Vset2) (V) subsequently applied to the scan electrodes SCN1 to SCNn.

The discharge cells in which the abnormal wall charges are stored are discharged by the positive voltage Vd (V) applied to the data electrodes D1 to Dm or the negative voltage Va (V) applied to the scan electrodes SCN1 to SCNn. When the discharge cells are discharged by the positive voltage Vd (V) applied to the data electrodes D1 to Dm, the discharges seem as if the erase discharges are forcibly terminated in the middle, but the state in which the wall charges are abnormally stored is resolved. The discharge cells are not discharged by the negative voltage Va (V) applied to the scan electrodes SCN1 to SCNn, the second positive voltage Vs (V) applied to the scan electrodes SCN1 to SCNn and the ramp waveform voltage gradually dropping toward the voltage (Va+Vset2) (V) subsequently applied to the scan electrodes SCN1 to SCNn, preventing the wall charges from being erased.

The discharge cells in which the erase discharges have been generated by the negative pulse voltage Va (V) applied to the scan electrodes SCN1 to SCNn are brought into any of a state in which the wall voltage has been erased, a state in which the wall voltage has been insufficiently erased by the weak erase discharges and a state in which the wall voltage has been inverted by the strong erase discharges.

The discharge cells in the state in which the wall charges have been erased are not discharged by the second positive voltage Vs (V) applied to the scan electrodes SCN1 to SCNn and the ramp waveform voltage gradually dropping toward the voltage (Va+Vset2) (V) subsequently applied to the scan electrodes SCN1 to SCNn.

The discharge cells in the state in which the wall charges have been insufficiently erased by the weak erase discharges are not discharged by the second positive voltage Vs (V) applied to the scan electrodes SCN1 to SCNn but subjected to weak discharges caused by the ramp waveform voltage gradually dropping toward the voltage (Va+Vset2) (V) applied to the scan electrodes SCN1 to SCNn, thus causing the wall charges to be adjusted such that normal writing can be performed.

The discharge cells in the state in which the wall voltage has been inverted by the strong erase discharges are discharged by the second positive voltage Vs (V) applied to the scan electrodes SCN1 to SCNn to cause the wall charges to be again inverted, and are subjected to the weak discharges caused by the ramp waveform voltage gradually dropping toward the voltage (Va+Vset2) (V) subsequently applied to the scan electrodes SCN1 to SCNn, thus causing the wall charges to be adjusted such that the normal writing can be performed.

When the abnormal wall charges are stored in the discharge cells, the discharge cells with the large storage amount of the wall charges and the small discharge time lag are more likely to be discharged by the positive voltage Vd (V) applied to the data electrodes D1 to Dm. The discharge cells that have not been discharged by the positive voltage Vd (V) applied to the data electrodes D1 to Dm are discharged by the negative voltage Va (V) applied to the scan electrodes SCN1 to SCNn. The weak discharges are induced by the dropping ramp waveform voltage applied to the scan electrodes SCN1 to SCNn in the discharge cells of which wall charges have been insufficiently erased by the negative voltage Va (V) applied to the scan electrodes SCN1 to SCNn, and the discharges are induced by the second positive voltage Vs (V) applied to the scan electrodes SCN1 to SCNn and the weak discharges are induced by the dropping ramp waveform voltage applied to the scan electrodes SCN1 to SCNn in the discharge cells in which the wall charges have been inverted by the negative voltage Va (V) applied to the scan electrodes SCN1 to SCNn.

As described above, the discharge cells in which the abnormal wall charges are stored are discharged by any of the positive voltage Vd (V) applied to the data electrodes D1 to Dm, the negative voltage Va (V) applied to the scan electrodes SCN1 to SCNn and the dropping ramp waveform voltage applied to the scan electrodes SCN1 to SCNn, thereby resolving the state in which the wall charges are abnormally stored.

In the subsequent write period, a voltage Ve2 is applied to the sustain electrodes SUS1 to SUSn when the scan electrodes SCN1 to SCNn are at a voltage 0 (V). Then, the negative voltage Va (V) is applied to the scan electrodes SCN1 to SCNn, and the scan electrodes SCN1 to SCNn are held at a voltage Vc (V).

The scan electrodes SCN1 to SCNn are held at the voltage Vc (V) after the negative voltage Va (V) is applied to the scan electrodes SCN1 to SCNn because the voltage Vc (V) needs to be raised from the voltage Va (V) in general circuit configurations; however, the present invention is not limited to this. For example, a circuit configuration capable of raising the voltage from the voltage 0 (V) to the voltage Vc (V) may be employed to eliminate the necessity of applying the negative voltage Va (V) to the scan electrodes SCN1 to SCNn.

While the voltage Ve2 (V) is applied to the sustain electrodes SUS1 to SUSn when the scan electrodes SCN1 to SCNn are at the voltage 0 (V), the voltage Ve2 (V) may be applied to the sustain electrodes SUS1 to SUSn when the scan electrodes SCN1 to SCNn are at the voltage Vc (V). Moreover, when the voltage Ve2 (V) is applied to the sustain electrodes SUS1 to SUSn while the scan electrodes SCN1 to SCNn are at the voltage Vc (V), the negative voltage Va (V) may not be applied to the scan electrodes SCN1 to SCNn.

Next, the positive write pulse voltage Vd (V) is applied to a data electrode Dk (k=1 to m), among the data electrodes D1 to Dm, of the discharge cell that should be displayed on a first line while the scan pulse voltage Va (V) is applied to the scan electrode SCN1 on the first line. At this time, a voltage at an intersection of the data electrode Dk and the scan electrode SCN1 attains a value obtained by adding the wall voltage on the data electrode Dk and the wall voltage on the scan electrode SCN1 to an externally applied voltage (Vd−Va)(V), exceeding the discharge start voltage. This induces write discharges between the data electrode Dk and the scan electrode SCN1 and between the sustain electrode SUS1 and the scan electrode SCN1, so that in the discharge cell, the positive wall charges are stored on the scan electrode SCN1, the negative wall charges are stored on the sustain electrode SUS1 and the negative wall charges are stored on the data electrode Dk. In this manner, the write operation in which the write discharge is induced in the discharge cell that should be displayed on the first line to cause the wall charges to be stored on each of the electrodes is performed. On the other hand, since a voltage at an intersection of a data electrode to which the positive write pulse voltage Vd (V) has not been applied and the scan electrode SCN1 does not exceed the discharge start voltage, the write discharge is not generated. The above-described write operation is sequentially performed in the discharge cells to the n-th line, and the write period is then finished.

In the subsequent sustain period, first, the sustain electrodes SUS1 to SUSn are returned to 0 (V), and the positive sustain pulse voltage Vs (V) is applied to the scan electrodes SCN1 to SCNn. At this time, in the discharge cell in which the write discharge has been induced, a voltage between the scan electrode SCNi and the sustain electrode SUSi attains a value obtained by adding the wall voltages on the scan electrode SCNi and the sustain electrode SUSi to the sustain pulse voltage Vs (V), exceeding the discharge start voltage. Then, the sustain discharge is induced between the scan electrode SCNi and the sustain electrode SUSi, the negative wall charges are stored on the scan electrode SCNi, and the positive wall charges are stored on the sustain electrode SUSi. Here, the positive wall charges are stored also on the data electrode Dk. In the discharge cell in which the write discharge has not been induced in the write period, the sustain discharge is not generated and the wall charges are held in a state at the end of the setup period.

Next, the scan electrodes SUS1 to SUSn are returned to 0 (V), and the positive sustain pulse voltage Vs (V) is applied to the sustain electrodes SUS1 to SUSn. Then, since the voltage between the sustain electrode SUSi and the scan electrode SCNi exceeds the discharge start voltage in the discharge cell in which the sustain discharge has been induced, the sustain discharge is again induced between the sustain electrode SUSi and the scan electrode SCNi, the negative wall charges are stored on the sustain electrode SUSi, and the positive wall charges are stored on the scan electrode SCNi. Similarly to this, the sustain pulse voltage is alternately applied to the respective scan electrodes SCN1 to SCNn and sustain electrodes SUS1 to SUSn, so that the sustain discharges are continuously performed in the discharge cells in which the write discharges have been induced in the write period. Note that so-called narrow pulses are applied between the scan electrodes SCN1 to SCNn and the sustain electrodes SUS1 to SUSn at the end of the sustain period to erase the wall charges on the scan electrodes SCN1 to SCNn and the sustain electrodes SUS1 to SUSn while the positive wall charges remain on the data electrode Dk. In this manner, the sustain operation in the sustain period is finished.

Next, the driving waveforms in the selective setup sub-field and the operations thereof will be described.

In a setup period, the sustain electrodes SUS1 to SUSn are held at Ve1 (V), the data electrodes D1 to Dm are held at 0 (V), and a dropping ramp waveform voltage gradually dropping from Vq (V) to Va (V) is applied to the scan electrodes SCN1 to SCNn. Then, weak setup discharge is generated in the discharge cell in which the sustain discharge has been induced in the sustain period of the preceding sub-field, so that the wall voltages on the scan electrode SCNi and the sustain electrode SUSi are weakened, and the wall voltage on the data electrode Dk is adjusted to a value suitable for a write operation. Meanwhile, the discharge is not generated and the wall charges are kept constant in a state at the end of the setup period of the preceding sub-field in the discharge cell in which the write discharge and the sustain discharge have not been induced in the preceding sub-field. As described above, the setup operation in the selective setup sub-field is the selective setup operation that generates the setup discharge in the discharge cell in which the sustain discharge has been induced in the preceding sub-field.

Since a write period and a sustain period are the same as those in the setup sub-field for all the cells, explanation is omitted.

Here, description will be made of the reason why the positive voltage Vd (V) is applied to the data electrodes D1 to Dm in a period between the application of the positive voltage Vs (V) to the scan electrodes SCN1 to SCNn and the application of the negative voltage Va (V) to the scan electrodes SCN1 to SCNn in the abnormal charges erase part of the setup period. In the discharge cells of which discharge start voltage is significantly decreased, the discharges are induced by the positive voltage Vs (V) applied to the scan electrodes SCN1 to SCNn in the abnormal wall charges erase part. When the positive voltage Vd (V) is not applied to the data electrodes D1 to Dm, the erase discharges are induced by the negative rectangular waveform voltage subsequently applied to the scan electrodes to cause the wall charges to be erased. As described above, in the cells of which discharge start voltage is significantly decreased, the wall charges are erased in the abnormal wall charges erase part in spite of no excessive positive wall charges stored on the scan electrodes, so that the normal write operation cannot be performed.

Accordingly, the positive voltage Vd (V) is applied to the data electrodes D1 to Dm in the period between the application of the positive voltage Vs (V) to the scan electrodes SCN1 to SCNn and the application of the negative voltage Va (V) to the scan electrodes SCN1 to SCNn in the abnormal charges erase part in the setup period for all the cells. This adjusts the wall charges of the discharge cells of which discharge start voltage is significantly decreased, prevents the wall charges from being erased in the abnormal wall charges erase part, and enables the normal write operation.

While one sub-field, for example, is shown as a sub-field in which the setup operation for all the cells is performed in the present embodiment, the present invention is not limited to this. For example, the setup operation for all the cells may be performed in a plurality of sub-fields, and the abnormal charges erase part may be provided in at least one setup period for all the cells of the plurality of setup periods for all the cells.

Next, description is made of one example of control of the data electrode driving circuit, the scan electrode driving circuit and the sustain electrode driving circuit in the setup period for all the cells in the first embodiment of the present invention while referring to the drawings.

Figure 5:
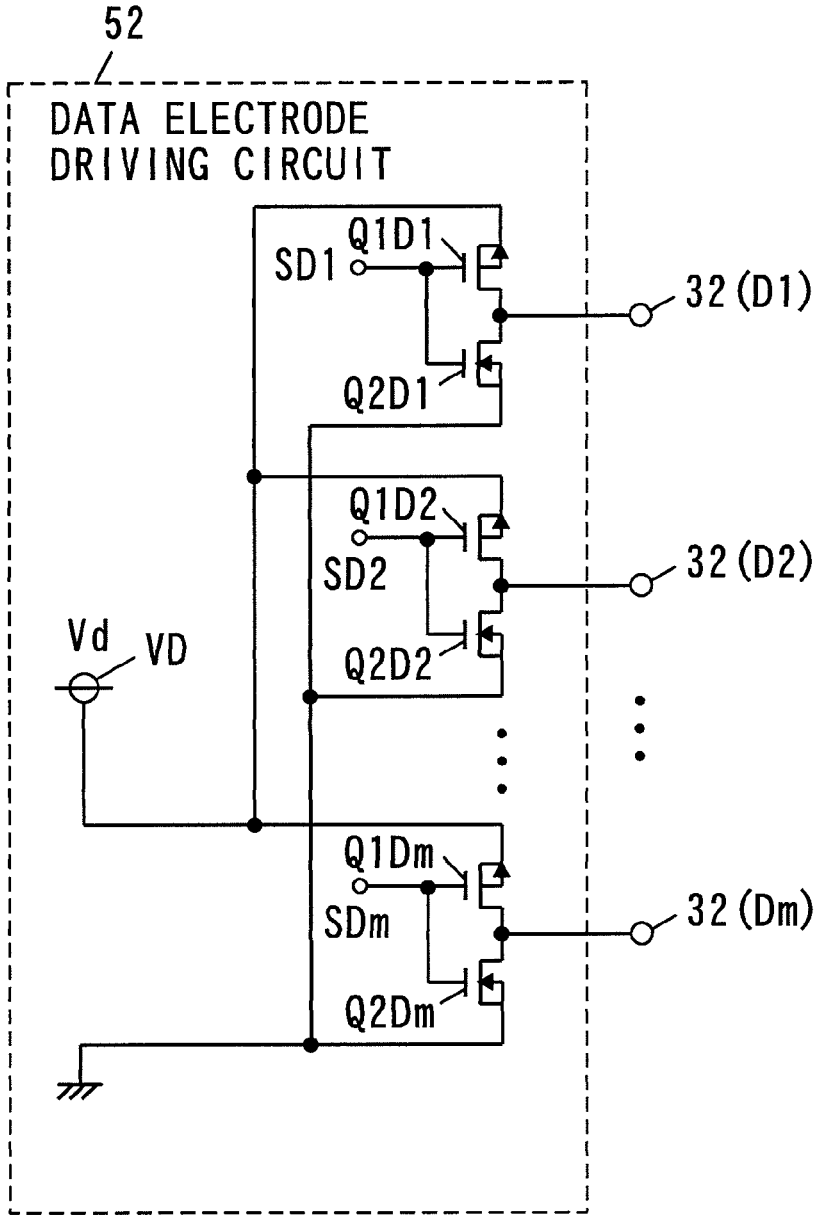
FIG. 5 is a circuit diagram of a data electrode driving circuit in the first embodiment of the present invention.

FIG. 5 is a circuit diagram of the data electrode driving circuit 52 in the first embodiment of the present invention. The data electrode driving circuit 52 includes a power supply VD that generates the voltage Vd, switching devices Q1D1 to Q1Dm and switching devices Q2D1 to Q2Dm. The data electrodes 32 (D1 to Dm) are independently connected to the power supply VD through the switching devices Q1D1 to Q1Dm, respectively, and clamped to the voltage Vd. Moreover, the data electrodes 32 (D1 to Dm) are independently grounded through the switching devices Q2D1 to Q2Dm, respectively, and clamped to 0 (V). In this manner, the data electrode driving circuit 52 independently drives the data electrodes 32, and applies the positive write pulse voltage Vd to the data electrodes 32.

Control signals SD1 to SDm of the above-described data electrode driving circuit 52 are supplied to the data electrode driving circuit 52 by the timing generating circuit 55 and the image signal processing circuit 51 as timing signals.

Figure 6:
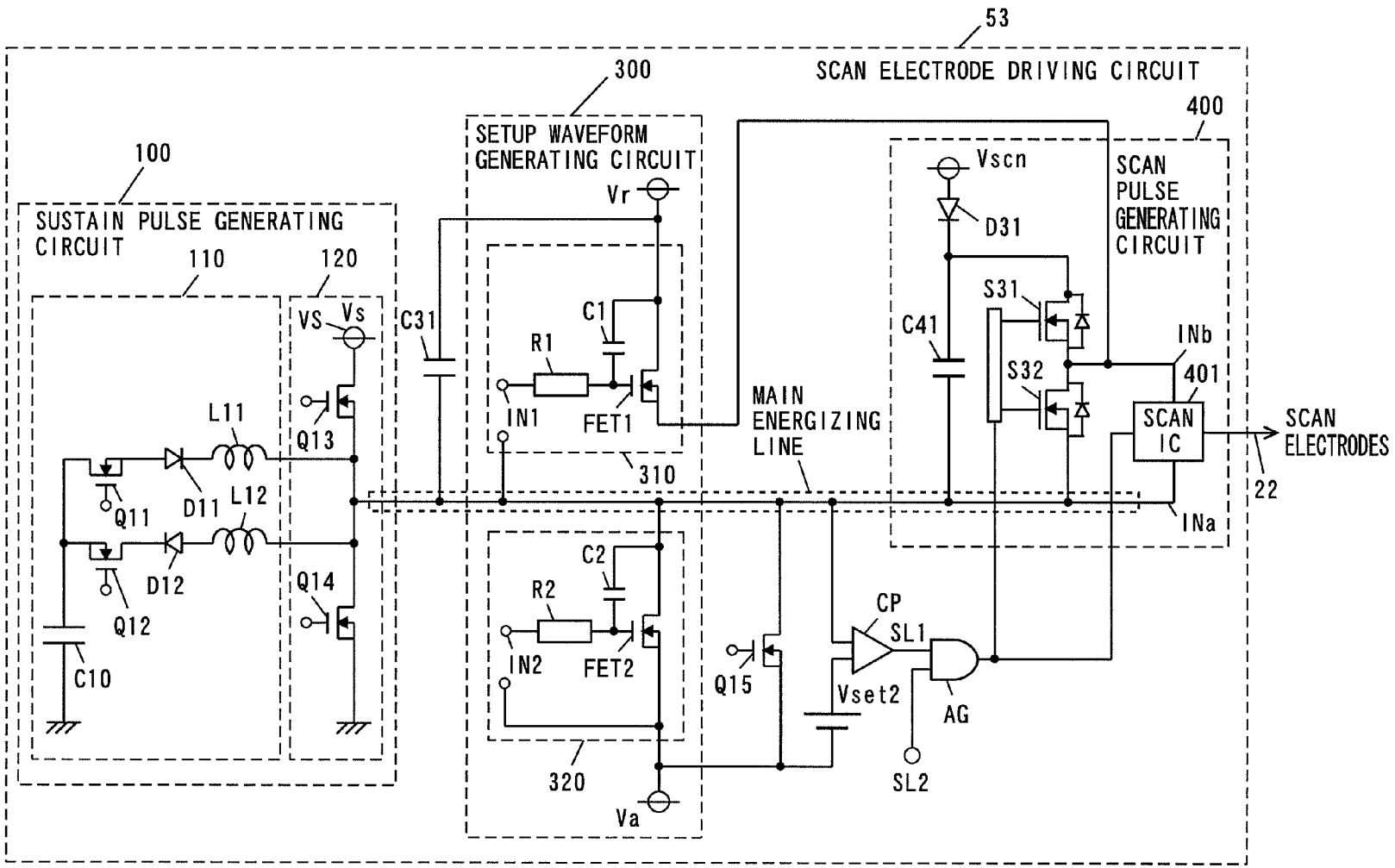
FIG. 6 is a circuit diagram of a scan electrode driving circuit in the first embodiment of the present invention.

Next, FIG. 6 is a circuit diagram of the scan electrode driving circuit 53 in the first embodiment of the present invention. The scan electrode driving circuit 53 includes the sustain pulse generating circuit 100 that generates the sustain pulses, a setup waveform generating circuit 300 that generates setup waveforms, a scan pulse generating circuit 400 that generates scan pulses and a switching device Q15 for clamping the scan electrodes 22 to the voltage Va.

The sustain pulse generating circuit 100 includes a power recovery unit 110 and a clamp unit 120. The power recovery unit 110 includes a capacitor C10 for power recovery, switching devices Q11, Q12, diodes D11, D12 for backflow prevention and inductors L11, L12 for resonance. The clamp unit 120 includes switching devices Q13, Q14. The power recovery unit 110 and the clamp unit 120 are connected to the scan electrodes 22 through the scan pulse generating circuit 400.

The power recovery unit 110 performs LC resonance of a panel capacitance (not shown) of the plasma display panel and the inductor L11 or the inductor L12 to form the rise and the fall of the sustain pulse voltage. Charges stored in the capacitor C11 for power recovery are transferred to an interelectrode capacitance Cp through the switching device Q11, the diode D11 and the inductor L11 at the time of the rise of the sustain pulse voltage. At the time of the fall of the sustain pulse, the charges stored in the panel capacitance are returned to the capacitor C10 for power recovery through the inductor L12, the diode D12 and the switching device Q12. In this manner, the sustain pulse is applied to the scan electrodes 22. As described above, since the power recovery unit 110 drives the scan electrodes 22 by the LC resonance without supplying power from the power supply, power consumption is ideally zero. Note that the capacitor C10 for power recovery has a sufficiently larger capacitance than that of the interelectrode capacitance Cp, and is charged at about Vs/2, which is half the voltage Vs of a power supply VS, so as to function as a power supply for the power recovery unit 110.

In the voltage clamp unit 120, the scan electrodes 22 are connected to the power supply VS through the switching device Q13 to be clamped to the voltage Vs. Moreover, the scan electrodes 22 are grounded through the switching device Q14 to be clamped to 0 (V). In this manner, the voltage clamp unit 120 drives the scan electrodes 22. Thus, an impedance at the time of voltage application by the voltage clamp unit 120 is small, so that a large discharge current caused by the strong sustain discharges can stably flow.

The sustain pulse generating circuit 100 applies the sustain pulse to the scan electrodes 22 using the power recovery unit 110 and the voltage clamp unit 120 by controlling the switching device Q11, the switching device Q12, the switching device Q13 and the switching device Q14. Note that these switching devices can be configured using generally-known devices such as a MOSFET (Metal Oxide Semiconductor Field-Effect Transistor) or an IGBT (Insulated-Gate Bipolar Transistor).

The setup waveform generating circuit 300 includes mirror integration circuits 310, 320, and generates the above-described setup waveforms while controlling the setup voltage in the setup operation for all the cells. The mirror integration circuit 310 includes a field-effect transistor FET1, a capacitor C1 and a resistor R1, and generates the rising ramp waveform voltage gradually rising in a ramp to the voltage Vr obtained by superimposing a voltage Vz on the voltage Vs.

The mirror integration circuit 320 includes a field-effect transistor FET2, a capacitor C2 and a resistor R2, and generates the dropping ramp waveform voltage gradually dropping in a ramp to the predetermined setup voltage Va. Note that respective input terminals of the mirror integration circuit 310 and the mirror integration circuit 320 are indicated as a terminal IN1 and a terminal IN2 in FIG. 6.

While the mirror integration circuits using the FETs that are practical and relatively simple in configuration are employed as the setup waveform generating circuit 300 in the present embodiment, the present invention is not limited to this configuration. Any circuit capable of generating the rising ramp waveform voltage and the dropping ramp waveform voltage may be employed.

The scan pulse generating circuit 400 includes a switching device S31, a switching device S32 and a scan IC (Integrated Circuit) 401, and selects either one of a voltage applied to a main energizing line (an energizing line, indicated by the broken line in the drawing, to which the sustain pulse generating circuit 100, the setup waveform generating circuit 300 and the scan pulse generating circuit 400 are connected in common) and a voltage obtained by superimposing a voltage Vscn on the voltage of the main energizing line, and applies the selected voltage to the scan electrodes. In the write period, for example, the voltage of the main energizing line is maintained at the negative voltage Va, and the negative voltage Va input to the scan IC 401 and the voltage Vc on which the voltage Vscn is superimposed on the negative voltage Va are switched to be output, thereby generating the above-described negative scan pulse voltage.

In addition, the scan electrode driving circuit 53 includes an AND gate AG that performs an AND operation and a comparator CP that compares the magnitude of the input signals input to the two input terminals. The comparator CP compares the voltage (Va+Vset2) obtained by superimposing the voltage Vset2 on the voltage Va and the voltage of the main energizing line, and outputs "0" when the main energizing line has a higher voltage, while outputting "1" in the other cases. Two input signals, that is, an output signal SL1 (CEL1) of the comparator CP and a switching signal SL2 are input to the AND gate AG. A timing signal output from the timing generating circuit 55 can be used as a switching signal CEL2, for example. Then, the AND gate AG outputs "1" when both the input signals are "1", while outputting "0" in the other cases. The output of the AND gate AG is input to the scan pulse generating circuit 400. The scan pulse generating circuit 400 outputs the voltage of the main energizing line when the output of the AND gate AG is "0", and outputs the voltage obtained by superimposing the voltage Vscn on the voltage of the main energizing line when the output of the AND gate AG is "1".

Figure 7:
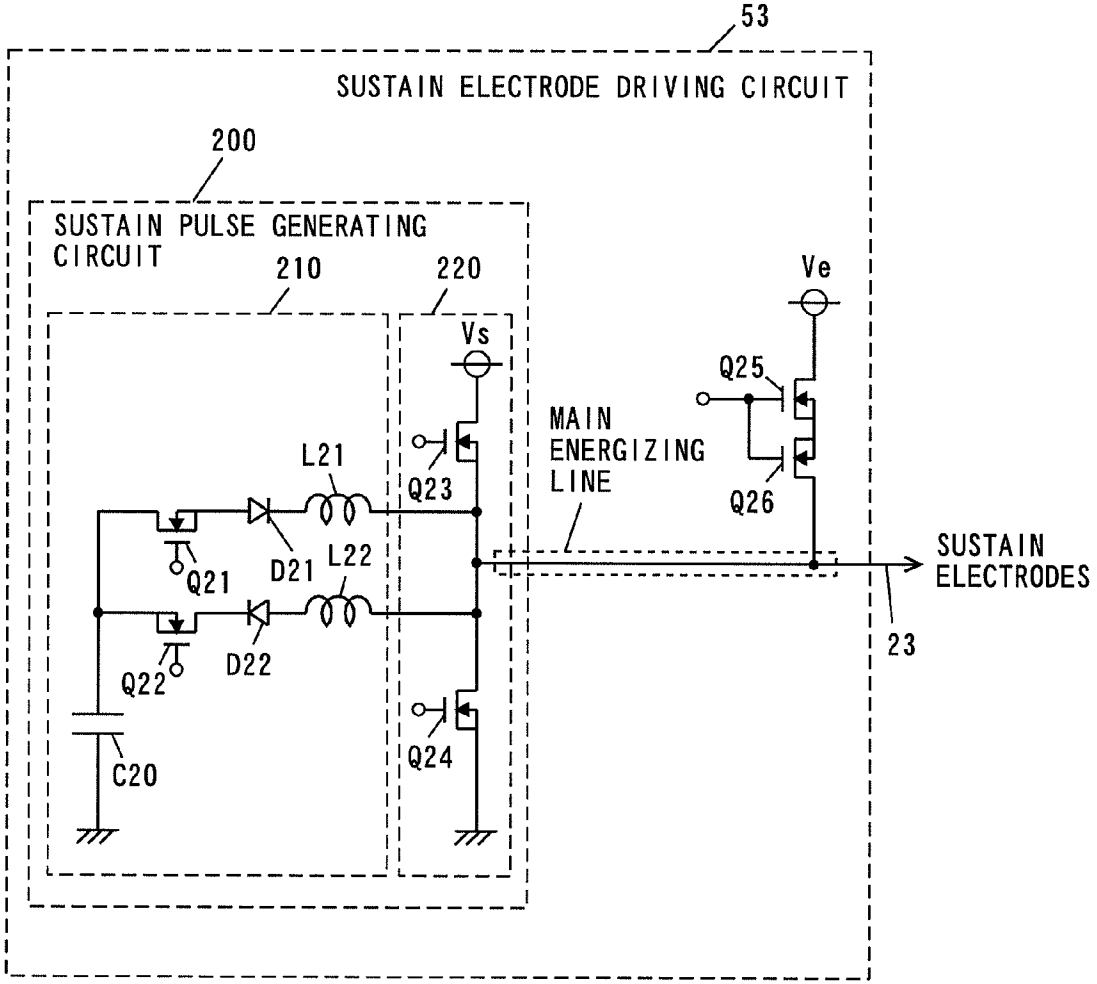
FIG. 7 is a circuit diagram of a sustain electrode driving circuit in the first embodiment of the present invention.

Next, FIG. 7 is a circuit diagram of the sustain electrode driving circuit 54 in the first embodiment of the present invention. The sustain electrode driving circuit 54 includes the sustain pulse generating circuit 200 that generates the sustain pulse, and switching devices Q26, Q27 for clamping the sustain electrodes 23 to a voltage Ve.

The sustain pulse generating circuit 200 includes a power recovery unit 210 and a clamp unit 220. The power recovery unit 210 includes a capacitor C20 for power recovery, switching devices Q21, Q22, diodes D21, D22 for backflow prevention and inductors L21, L22 for resonance. The clamp unit 120 includes switching devices Q23, Q24. The power recovery unit 210 and the clamp unit 220 are connected to the sustain electrodes 23. These switching devices can be configured using generally-known devices such as a MOSFET or an IGBT.

Figure 8:
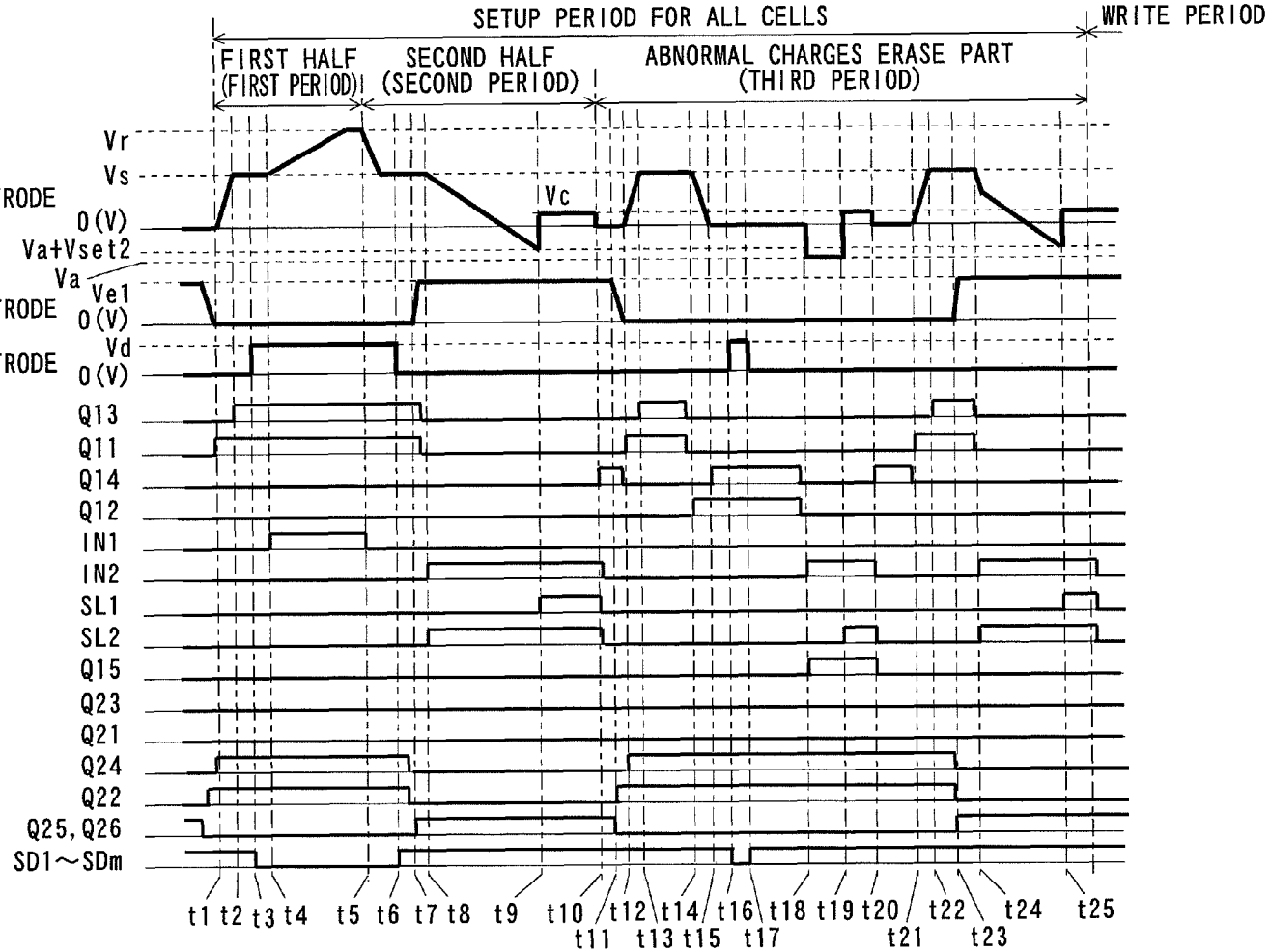
FIG. 8 is a timing chart for explaining an example of the operation of the scan electrode driving circuit in a setup period for all cells in the first embodiment of the present invention.

FIG. 8 is a timing chart for explaining examples of the operations of the data electrode driving circuit 52, the scan electrode driving circuit 53 and the sustain electrode driving circuit 54 in the setup period for all the cells in the present embodiment. The setup period for all the cells is divided into three periods: the first half (the first period), the second half (the second period) and the abnormal charges erase part (the third period) when described.

(The First Half)

When the switching device Q11 of the scan electrode driving circuit 53 is turned on at time t1, a current starts flowing from the capacitor C10 for power recovery to the scan electrodes 22 through the switching device Q11, the diode D11 and the inductor L11, and the voltage of the scan electrodes 22 starts rising. Then, the switching device Q13 of the scan electrode driving circuit 53 is turned on at time t2. Since the scan electrodes 22 are connected to the power supply VS through the switching device Q13, the scan electrodes 22 are clamped to the voltage Vs.

The control signals SD1 to SDm of the switching devices Q1D1 to Q1Dm and the switching devices Q2D1 to Q2Dm of the data electrode driving circuit 52 attain Lo (low level) at time t3. The switching devices Q1D1 to Q1Dm are turned on, the switching devices Q2D1 to Q2Dm are turned off and the voltage of the data electrodes 32 are clamped to the voltage Vd. The switching devices Q1D1 to Q1Dm are configured with devices that are turned on when the control signals are Lo.

The potential of the input terminal IN1 of the mirror integration circuit 310 attains a "high level" at time t4. Specifically, a voltage 15 (V), for example, is applied to the input terminal IN1. Then, a constant current flows from the resistor R1 to the capacitor C1, and a source voltage of the transistor FET1 rises in a ramp to be superimposed on the voltage Vs through a capacitor 31. The output voltage of the scan electrode driving circuit 53 also starts rising in a ramp. This voltage continues to rise until it reaches Vr. When the output voltage rises to Vr, the output voltage is fixed to Vr during a period where the potential of the input terminal IN1 is in a "high level". In this manner, the rising ramp waveform voltage gradually rising from the voltage Vs to the voltage Vr that exceeds the discharge start voltage is applied to the scan electrodes 22.

(The Second Half)

When the potential of the input terminal IN1 attains a "low level" at time t5, the voltage of the scan electrodes 22 drops to the voltage Vs. The control signals SD1 to SDm of the switching devices Q1D1 to Q1Dm and the switching devices Q2D1 to Q2Dm of the data electrode driving circuit 52 attain Hi (high level) at time t6. The switching devices Q1D1 to Q1Dm are turned off, the switching devices Q2D1 to Q2Dm are turned on, and the voltage of the data electrodes 32 is clamped to the voltage 0 (V).

When the switching devices Q25, Q26 of the sustain electrode driving circuit 54 are turned on at time t7, the voltage of the sustain electrodes 22 rises to Ve1. The switching device Q21 and the switching device Q23 are turned off immediately before time t7.

The potential of the input terminal IN2 of the mirror integration circuit 320 attains a "high level" at time t8. Specifically, the voltage 15 (V), for example, is applied to the input terminal IN2. Then, a constant current flows from the resistor R2 to the capacitor C2, a drain voltage of the transistor FET2 drops in a ramp, and the output voltage of the scan electrode driving circuit 53 also starts dropping in a ramp. The switching Q11, Q13 are turned off immediately before time t8.

At this time, this dropping ramp waveform voltage (the voltage of the main energizing line) and the voltage (Va+Vset2) obtained by adding the voltage Vset2 to the voltage Va are compared in the comparator CP, and the output signal SL1 output from the comparator CP is switched from "0" to "1" at time t9 where the dropping ramp waveform voltage attains not more than the voltage (Va+Vset2). Here, since the switching signal SL2 is "1", the inputs of the AND gate AG are both "1", and "1" is output from the AND gate AG. This causes the voltage Vc obtained by superimposing the voltage Vscn on this dropping ramp waveform voltage to be output from the scan pulse generating circuit 400.

This allows the minimum voltage of the dropping ramp waveform voltage to be (Va+Vset2).

(The Abnormal Charges Erase Part)

When the switching device 14 is turned on at time t10, the voltage of the scan electrodes 22 drops to 0 (V).

The switching device Q22 of the sustain electrode driving circuit 54 is turned on at time t11. Then, the current starts flowing from the sustain electrodes 23 to the capacitor C20 through the inductor L22, the diode D22 and the switching device Q22, and the voltage of the sustain electrodes 23 starts dropping.

The switching device Q24 is turned on at time t12. Since the sustain electrodes 23 are grounded through the switching device Q24, the voltage of the sustain electrodes 23 is clamped to 0 (V). Furthermore, the switching device Q11 of the scan electrode driving circuit 53 is turned on at the same timing as the switching device Q24 turned on at time t12. Then, the current starts flowing from the capacitor C10 for power recovery to the scan electrodes 22 through the switching device Q11, the diode D11 and the inductor L11, and the voltage of the scan electrodes 22 starts rising.

The switching device Q13 of the scan electrode driving circuit 53 is turned on at time t13. Since the scan electrodes 22 are connected to the power supply VS through the switching device Q13, the scan electrodes 22 are clamped to the voltage Vs.

The switching device Q12 of the scan electrode driving circuit 53 is turned on at time t14. Then, the current starts flowing from the scan electrodes 22 to the capacitor C10 through the inductor L12, the diode D12 and the switching device Q12, and the voltage of the scan electrodes 22 starts dropping.

The switching device Q14 is turned on at time t15. Since the scan electrodes 22 are grounded through the switching device Q14, the voltage of the scan electrodes 22 are clamped to 0 (V).

The control signals SD1 to SDm of the switching devices Q1D1 to Q1Dm and the switching devices Q2D1 to Q2Dm of the data electrode driving circuit 52 attain Lo at time t16. The switching devices Q1D1 to Q1Dm are turned on, the switching devices Q2D1 to Q2Dm are turned off, and the voltage of the data electrodes 32 are clamped to the voltage Vd.

The control signals SD1 to SDm of the switching devices Q1D1 to Q1Dm and the switching devices Q2D1 to Q2Dm of the data electrode driving circuit 52 attain Hi at time t17. The switching devices Q1D1 to Q1Dm are turned off, the switching devices Q2D1 to Q2Dm are turned on, and the voltage of the data electrodes 32 is clamped to the voltage 0 (V).

The potential of the input terminal IN2 of the mirror integration circuit 320 of the scan electrode driving circuit 53 attains a "high level" and the switching device Q15 is turned on at time t18. Then, the voltage of the scan electrodes 22 is clamped to the voltage Va. The switching devices Q12, Q14 are turned off immediately before time t8.

The switching signal SL2 of the AND gate AG of the scan electrode driving circuit 53 attains "1" at time t19. The voltage of the main energizing line and the voltage (Va+Vset2) obtained by adding the voltage Vset2 to the voltage Va are compared in the comparator CP. Since the voltage of the main energizing line is the voltage Va and is not more than the voltage (Va+Vset2), the output signal SL1 output from the comparator CP is "1". Accordingly, the voltage Vc obtained by superimposing the voltage Vscn on the voltage of the main energizing line is output from the scan pulse generating circuit 400, and the voltage of the scan electrodes 22 attains Vc.

The switching device Q14 of the scan electrode driving circuit 53 is turned on at time t20. Then, the scan electrodes 22 are clamped to the voltage 0 (V). The switching device Q15 is turned off, the switching signal SL2 of the AND gate AG attains "0", and the potential of the input terminal IN2 of the mirror integration circuit 320 attains a "low level" immediately before time t20.

The switching device Q11 of the scan electrode driving circuit 53 is turned on at the same timing as the switching device Q24 turned on at time t21. Then, the current starts flowing from the capacitor C10 for power recovery to the scan electrodes 22 through the switching device Q11, the diode D11 and the inductor L11, and the voltage of the scan electrodes 22 starts rising.

The switching device Q13 of the scan electrode driving circuit 53 is turned on at time t22. Since the scan electrodes 22 are connected to the power supply VS through the switching device Q13, the scan electrodes 22 are clamped to the voltage Vs.

When the switching devices Q25, Q26 of the sustain electrode driving circuit 54 are turned on at time t23, the voltage of the sustain electrodes 22 rises to the voltage Ve1. The switching devices Q21, Q23 are turned off immediately before time t23.

The input terminal IN2 of the mirror integration circuit 320 attains the "high level" at time t24. Specifically, a voltage 15 (V), for example, is applied to the input terminal IN2. Then, a constant current flows from the resistor R2 to the capacitor C2, the drain voltage of the FET2 drops in a ramp, and the output voltage of the scan electrode driving circuit 53 also starts dropping in a ramp. The switching Q11, Q13 are turned off immediately before time t24.

At this time, this dropping ramp waveform voltage (the voltage of the main energizing line) and the voltage (Va+Vset2) obtained by adding the voltage Vset2 to the voltage Va are compared in the comparator CP, and the output signal SL1 output from the comparator CP is switched from "0" to "1" at time t25 where the dropping ramp waveform voltage attains not more than the voltage (Va+Vset2). Here, since the switching signal SL2 is "1", the inputs of the AND gate AG are both "1", and "1" is output from the AND gate AG. This causes the voltage Vc obtained by superimposing the voltage Vscn on this dropping ramp waveform voltage to be output from the scan pulse generating circuit 400.

As described above, the data electrode driving circuit has a circuit configuration shown in FIG. 5, the scan electrode driving circuit 53 has a circuit configuration shown in FIG. 6, the sustain electrode driving circuit has a circuit configuration shown in FIG. 7, and the data electrode driving circuit 52, the scan electrode driving circuit 53 and the sustain electrode driving circuit 54 are driven at the timings shown in the timing chart of FIG. 8 in the present embodiment. Accordingly, the driving waveforms applied to the data electrodes D1 to Dm, the scan electrodes 22 and the sustain electrodes 23 in the setup period for all the cells can be achieved in the present embodiment. In particular, the positive pulse voltage is applied to the data electrodes in the period between the application of the positive pulse voltage to the scan electrodes and the application of the negative pulse voltage to the scan electrodes in the abnormal charges erase part of the setup period for all the cells. This allows the normal write discharges to be performed in the subsequent write period, resulting in display of images with excellent quality.

(2) Second Embodiment

Next, a plasma display device according to a second embodiment of the present invention will be described.

Figure 9:
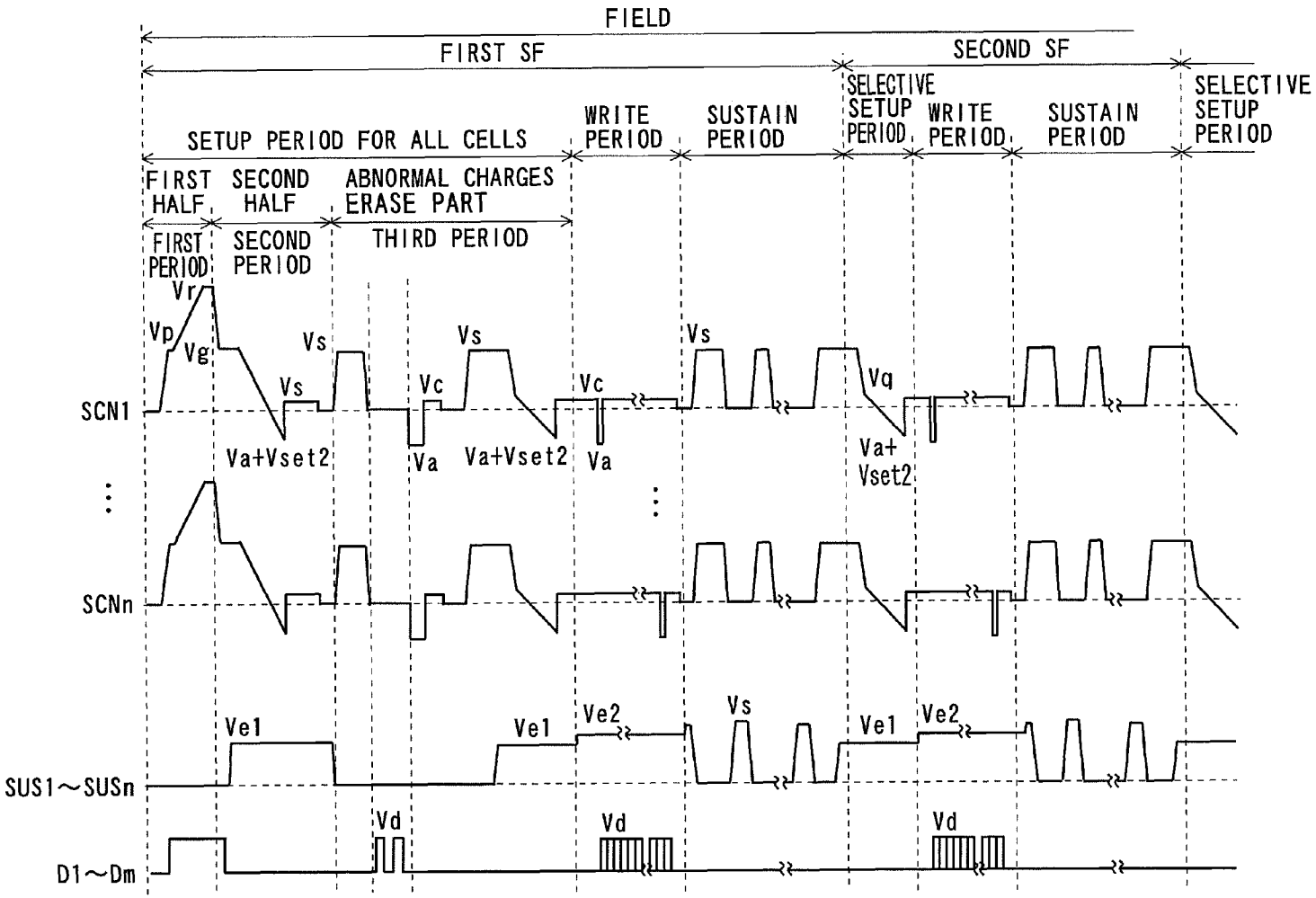
FIG. 9 is a diagram showing driving waveforms applied to respective electrodes of a panel according to a second embodiment of the present invention.

The structural diagram of the plasma display device of the present invention is the same as that of the first embodiment. The present embodiment is different from the first embodiment in the driving waveforms applied in the abnormal charges erase part of the setup period. FIG. 9 is a diagram showing driving waveforms applied to the respective electrodes of the panel according to the second embodiment of the present invention, and shows the driving waveforms of the setup sub-field for all the cells and the selective setup sub-field. Moreover, FIG. 9 shows the driving waveforms when the first SF is the setup sub-field for all the cells and the second SF is the selective setup sub-field.

First, the driving waveforms in the setup sub-field for all the cells and the operations thereof will be described. The setup period for all the cells is divided into periods: the first half (the first period), the second half (the second period) and the abnormal charges erase part (the third period) when described. Since the first half and the second half of the setup period for all the cells are the same as those in the first embodiment, detailed description thereof is omitted. When the shortage of the priming or the like causes the larger discharge time lag, the excessive positive wall charges are stored on the scan electrodes SCN1 to SCNn in the first half and the second half of the setup period for all the cells.

In the abnormal charges erase part of the setup period, the sustain electrodes SUS1 to SUSn are returned to 0 (V). The first positive voltage Vs (V) that does not reach the discharge start voltage is applied to the scan electrodes SCN1 to SCNn for 5 to 20 μs, and a first positive voltage Vd (V) is subsequently applied to the data electrodes D1 to Dm for 100 ns to 1 μs. After an interval of 100 ns to 1 μs, a second positive voltage Vd (V) is applied to the data electrodes D1 to Dm for 100 ns to 1 μs.

Furthermore, the second positive voltage Vs (V) is applied to the scan electrodes SCN1 to SCNn, and the ramp waveform voltage gradually dropping toward the voltage (Va+Vset2) (V) is applied to the scan electrodes SCN1 to SCNn. At this time, application time of the first positive voltage Vd (V) applied to the data electrodes D1 to Dm is set shorter than application time of the second positive voltage Vd (V) applied to the data electrodes D1 to Dm.

After that, the negative voltage Va (V) is applied to the scan electrodes SCN1 to SCNn for such a short period of time as not more than 5 μs. During this period, the discharges are not generated in the discharge cells of which discharge start voltage is not decreased among the discharge cells in which the setup discharges have been stably performed, and the wall voltage is held in the state in the second half of the setup period. In the discharge cell in which the abnormal positive wall charges are stored on the scan electrode SCNi and the discharge cells of which discharge start voltage is decreased, however, application of the voltage Vs (V) to the scan electrodes SCN1 to SCNn causes the voltage of the discharge cell to exceed the discharge start voltage, thus generating the strong discharge to cause the wall voltage on the scan electrode SCNi to be inverted.

The first positive voltage Vd (V) is applied to the data electrodes D1 to Dm of the discharge cells of which discharge start voltage is significantly decreased. When there is no significant difference in the discharge time lags of the respective discharge cells of red, green and blue, the discharges are induced in the discharge cells of red, green and blue by the first positive voltage Vd (V) applied to the data electrodes D1 to Dm to allow the wall charges to be adjusted so that the write operation can be normally performed in the write period. When the discharge time lags of the respective discharge cells of red, green and blue are significantly different, however, the discharge cells with the large discharge time lag are not discharged by the first positive voltage Vd (V) applied to the data electrodes D1 to Dm in some cases. When the discharge time lag of the discharge cells of green is small and the discharge time lags of the discharge cells of red and blue are large, for example, the application time of the first positive voltage Vd (V) applied to the data electrodes D1 to Dm is determined according to the characteristics of the discharge cells of green with the small discharge time lag.

The application time of the first positive voltage Vd (V) is set so short as about 150 ns according to the characteristics of the discharge cells of green with the small discharge time lag. Description is made of the need for adjusting the first positive voltage Vd (V) applied to the data electrodes D1 to Dm to the characteristics of the discharge cells of green with the small discharge time lag. When the application time of the first positive voltage Vd (V) is too long, such as about 400 ns, the erase discharges cannot be terminated in the middle and the wall charges are erased in the discharge cells of green with the small discharge time lag. Therefore, the application time of the first positive voltage Vd (V) applied to the data electrodes D1 to Dm is set very short according to the characteristics of the discharge cells of green with the small discharge time lag.

The discharge cells of blue and red with the large discharge time lags are not discharged in some cases by the first positive voltage Vd (V) applied for the short period of time.

Therefore, the second positive voltage Vd (V) is subsequently applied to the data electrodes D1 to Dm. The application time of the second positive voltage Vd (V) is determined according to the characteristics of the discharge cells of red and blue with the large discharge time lags. The discharge cells of blue and red that have not been discharged by the first positive voltage Vd (V) applied to the data electrodes D1 to Dm for the short period of time because of the large discharge time lags are discharged by the second positive voltage Vd (V) applied to the data electrodes D1 to Dm. The application time of the second positive voltage Vd (V) applied to the data electrodes D1 to Dm is about 400 ns.

Since the discharge cells of green with the small discharge time lag are discharged by the first positive voltage Vd (V) applied to the data electrodes D1 to Dm, those discharge cells are not discharged by the second positive voltage Vd (V) applied to the data electrodes D1 to Dm. In this manner, the cells of green with the small discharge time lag are discharged by the first positive voltage Vd (V) applied to the data electrodes D1 to Dm, and the discharge cells, which have not been discharged by the first positive voltage Vd (V) applied to the data electrodes D1 to Dm, among the discharge cells of red and blue with the large discharge time lags are discharged by the second positive voltage Vd (V) applied to the data electrodes D1 to Dm. These discharges cause the wall charges in the cells to be adjusted such that the write operation can be normally performed in the write period.

The discharge cells of which discharge start voltage is decreased are discharged by either of the first positive voltage Vd (V) applied to the data electrodes D1 to Dm and the second positive voltage Vd (V) applied to the data electrodes D1 to Dm, and are not discharged by the negative voltage Va (V) applied to the scan electrodes SCN1 to SCNn. The discharge cells of which discharge start voltage is decreased are not discharged by the negative voltage Va (V) applied to the scan electrodes SCN1 to SCNn, the second positive voltage Vs (V) applied to the scan electrodes SCN1 to SCNn and the ramp waveform voltage gradually dropping toward the voltage (Va+Vset2) (V) subsequently applied to the scan electrodes SCN1 to SCNn, preventing the wall charges from being erased.

The discharge cells in which the abnormal wall charges are stored are discharged by any of the first positive voltage Vd (V) applied to the data electrodes D1 to Dm, the second positive voltage Vd (V) applied to the data electrodes D1 to Dm and the negative voltage Va (V) applied to the scan electrodes SCN1 to SCNn. When the discharges are generated by the positive voltage Vd (V) applied to the data electrodes D1 to Dm or the second positive voltage Vd (V) applied to the data electrodes D1 to Dm, the discharges seem as if the erase discharges are forcibly terminated in the middle, but the state in which the wall charges are abnormally stored is resolved.

The discharge cells in which the erase discharges have been generated by the negative pulse voltage Va (V) applied to the scan electrodes SCN1 to SCNn are brought into any of the state in which the wall voltage has been erased, the state in which the wall voltage has been insufficiently erased by the weak erase discharges and the state in which the wall voltage has been inverted by the strong erase discharges. The discharge cells in the state in which the wall charges have been erased are not discharged by the second positive voltage Vs (V) applied to the scan electrodes SCN1 to SCNn and the ramp waveform voltage gradually dropping toward the voltage (Va+Vset2) (V) subsequently applied to the scan electrodes SCN1 to SCNn.

The discharge cells in the state in which the wall charges have been insufficiently erased by the weak erase discharges are not discharged by the second positive voltage Vs (V) applied to the scan electrodes SCN1 to SCNn but subjected to the weak discharges caused by the ramp waveform voltage gradually dropping toward the voltage (Va+Vset2) (V) applied to the scan electrodes SCN1 to SCNn, thus causing the wall charges to be adjusted such that the normal writing can be performed.

The discharge cells in the state in which the wall voltage has been inverted by the strong erase discharges are discharged by the second positive voltage Vs (V) applied to the scan electrodes SCN1 to SCNn to cause the wall charges to be again inverted, and subjected to the weak discharges caused by the ramp waveform voltage gradually dropping toward the voltage (Va+Vset2) (V) subsequently applied to the scan electrodes SCN1 to SCNn, thus causing the wall charges to be adjusted such that the normal writing can be performed.

When the abnormal wall charges are stored in the discharge cells, the discharge cells with the large storage amount of the wall charges and the small discharge time lag are more likely to be discharged by the first positive voltage Vd (V) applied to the data electrodes D1 to Dm.

The discharge cells that have not been discharged by the first positive voltage Vd (V) applied to the data electrodes D1 to Dm are discharged by the second positive voltage Vd (V)

applied to the data electrodes D1 to Dm or the negative voltage Va (V) applied to the scan electrodes SCN1 to SCNn. The weak discharges are induced by the dropping ramp waveform voltage applied to the scan electrodes SCN1 to SCNn in the discharge cells of which wall charges have been insufficiently erased by the negative voltage Va (V) applied to the scan electrodes SCN1 to SCNn, and the discharges are induced by the second positive voltage Vs (V) applied to the scan electrodes SCN1 to SCNn and the weak discharges are subsequently induced by the dropping ramp waveform voltage applied to the scan electrodes SCN1 to SCNn in the discharge cells in which the wall charges have been inverted by the negative voltage Va (V) applied to the scan electrodes SCN1 to SCNn.

As described above, the discharge cells in which the abnormal wall charges are stored are discharged by any of the first positive voltage Vd (V) applied to the data electrodes D1 to Dm, the second positive voltage Vd (V) applied to the data electrodes D1 to Dm, the negative voltage Va (V) applied to the scan electrodes SCN1 to SCNn and the dropping ramp waveform voltage applied to the scan electrodes SCN1 to SCNn, thereby resolving the state in which the wall charges are abnormally stored.

Since the subsequent write period, sustain period and selective setup sub-field are the same as those in the first embodiment, explanation is omitted.

As described above, the first positive voltage V'd (V) and the second positive voltage Vd (V) are applied to the data electrodes D1 to Dm in the period between the application of the positive voltage Vs (V) to the scan electrodes SCN1 to SCNn and the application of the negative voltage Va (V) to the scan electrodes SCN1 to SCNn in the abnormal charges erase part of the setup period for all the cells. This adjusts the wall charges of the discharge cells of which discharge start voltage is significantly decreased, prevents the wall charges from being erased in the abnormal wall charges erase part, and enables the normal write operation even when the respective discharge cells of red, green and blue have the different characteristics such as the discharge time lags.

While one sub-field, for example, is shown as a sub-field in which the setup operation for all the cells is performed in the present embodiment, the present invention is not limited to this. For example, the setup operation for all the cells may be performed in a plurality of sub-fields, and the abnormal charges erase part may be provided in at least one setup period for all the cells of the plurality of setup periods for all the cells.

Figure 10:
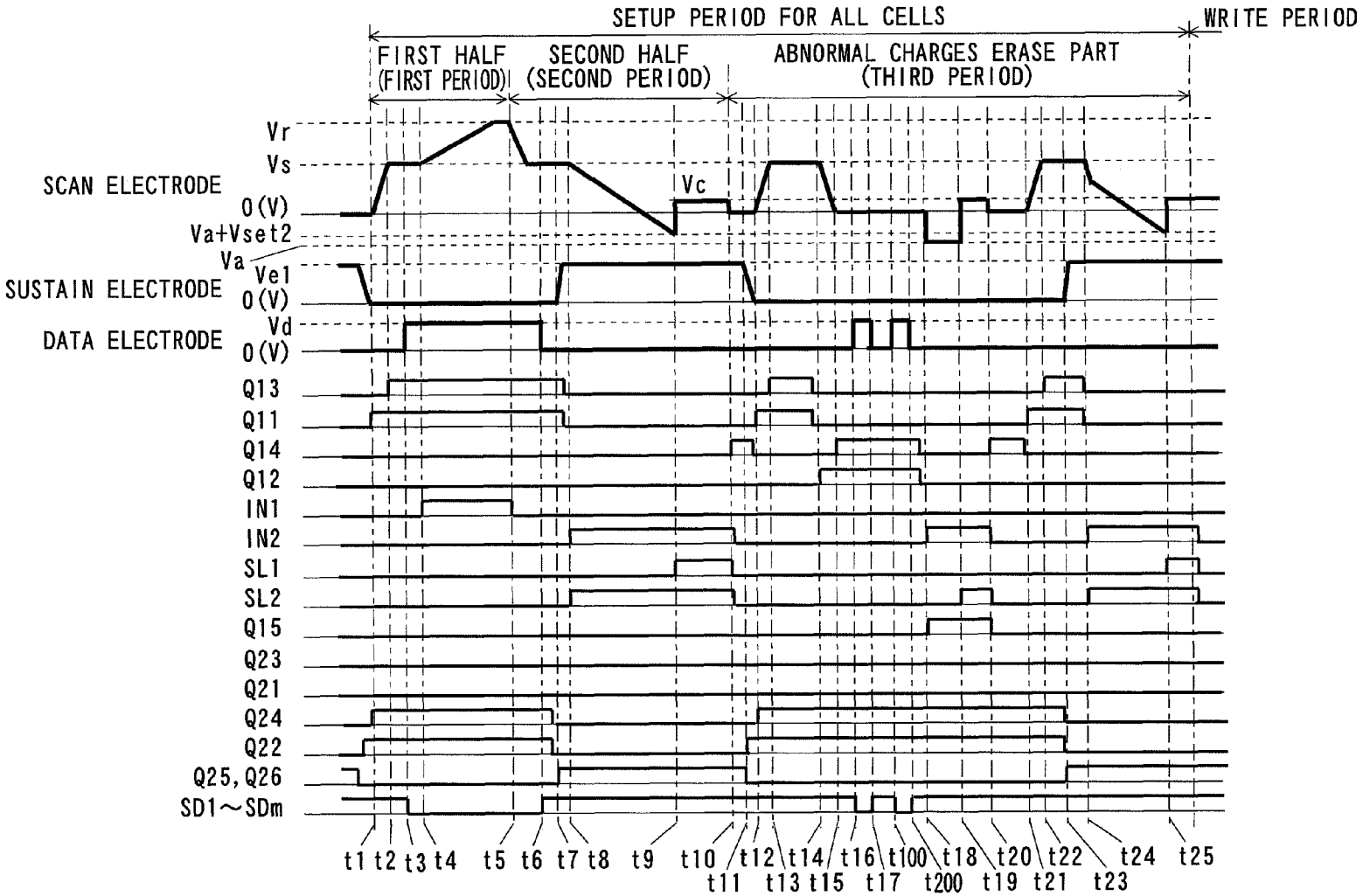
FIG. 10 is a timing chart for explaining an example of the operation of a scan electrode driving circuit in a setup period for all cells in the second embodiment of the present invention.

Next, description is made of one example of control of the data electrode driving circuit, the scan electrode driving circuit and the sustain electrode driving circuit in the setup period for all the cells in the embodiment of the present invention while referring to the drawing. The data electrode driving circuit, the scan electrode driving circuit and the sustain electrode driving circuit employed in the present embodiment are the same as those in the first embodiment. FIG. 10 is a timing chart for explaining examples of the operations of the data electrode driving circuit 52, the scan electrode driving circuit 53 and the sustain electrode driving circuit 54 in the setup period for all the cells in the first embodiment. Since a period from time t1 to time t17 is the same as that of the first embodiment, explanation is omitted.

At time t100 following time t7, the control signals SD1 to SDm of the switching devices Q1D1 to Q1Dm and the switching devices Q2D1 to Q2Dm of the data electrode driving circuit 52 attain Lo. The switching devices Q1D1 to Q1Dm are turned on, the switching devices Q2D1 to Q2Dm are turned off, and the voltage of the data electrodes 32 is clamped to the voltage Vd.

The control signals SD1 to SDm of the switching devices Q1D1 to Q1Dm and the switching devices Q2D1 to Q2Dm of the data electrode driving circuit 52 attain Hi at time 200. The switching devices Q1D1 to Q1Dm are turned off, the switching devices Q2D1 to Q2Dm are turned on, and the voltage of the data electrodes 32 is clamped to the voltage 0 (V).

Since a period from time t18 to time t25 is the same as that in the first embodiment of the present invention, explanation is omitted.

As described above, the data electrode driving circuit has the circuit configuration shown in FIG. 5, the scan electrode driving circuit 53 has the circuit configuration shown in FIG. 6, the sustain electrode driving circuit has the circuit configuration shown in FIG. 7, and the data electrode driving circuit 52, the scan electrode driving circuit 53 and the sustain electrode driving circuit 54 are driven at the timings shown in the timing chart of FIG. 10 in the present embodiment. Accordingly, the driving waveforms applied to the data electrodes D1 to Dm, the scan electrodes 22 and the sustain electrodes 23 in the setup period for all the cells can be achieved in the present embodiment.

In particular, the positive pulse voltage is applied twice to the data electrodes between the application of the positive pulse voltage to the scan electrodes and the application of the negative pulse voltage to the scan electrodes in the abnormal charges erase part of the setup period for all the cells. This allows the normal write discharges to be performed in the subsequent write period, resulting in display of images with excellent quality even when the discharge cells have the different discharge time lags.

(3) Third Embodiment

Figure 11:
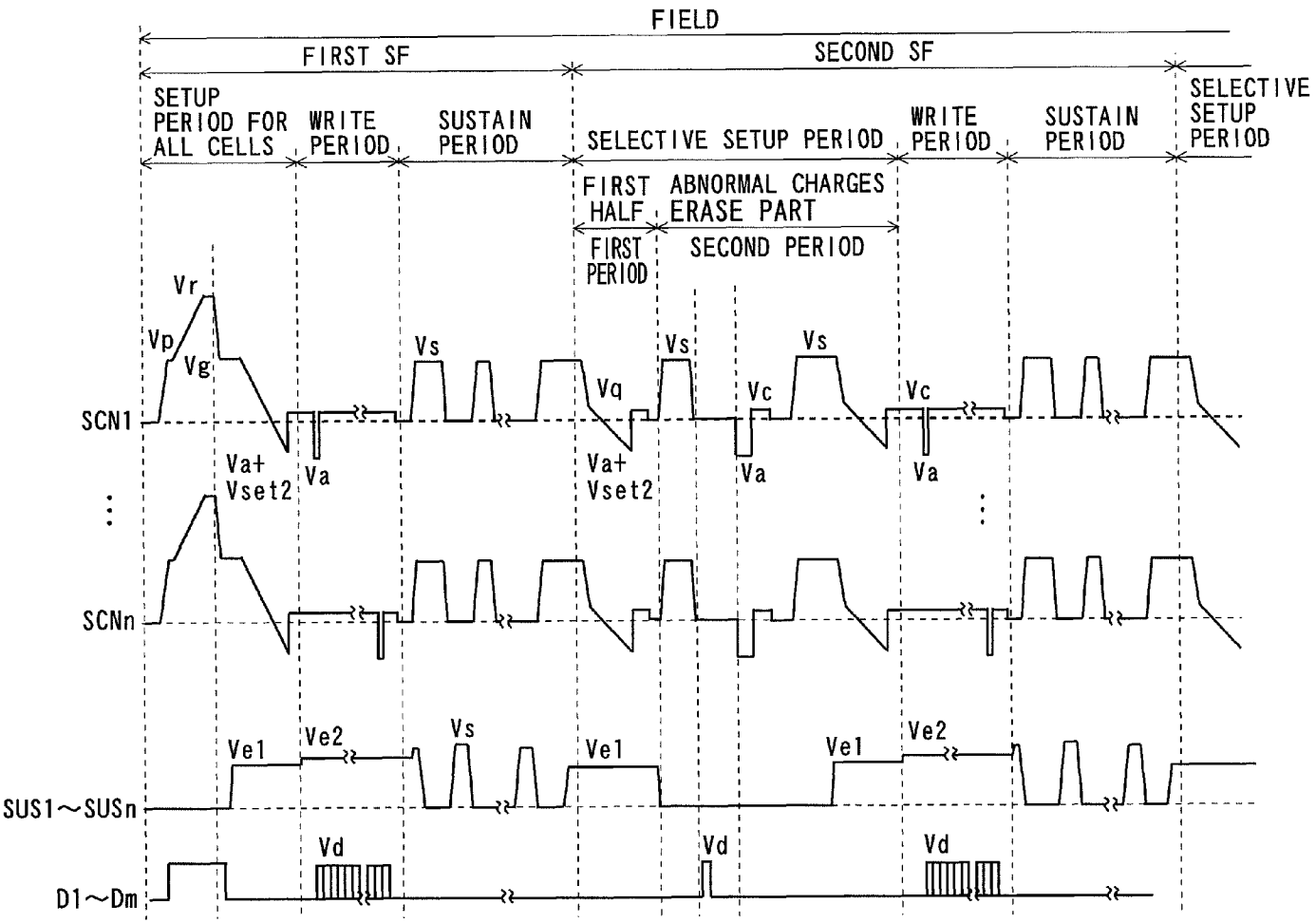
FIG. 11 is a diagram showing driving waveforms applied to respective electrodes of a panel in a third embodiment of the present invention.

A third embodiment of the present invention will be described. The structural diagram of a plasma display device of this embodiment is the same as that of the first embodiment. The present embodiment is different from the first embodiment in that the abnormal charges erase part is provided not in the setup period for all the cells but in the selective setup period. FIG. 11 is a diagram showing driving waveforms applied to the respective electrodes of the panel in the present embodiment, and shows the driving waveforms in the setup sub-field for all the cells and the selective setup sub-field. FIG. 11 shows the driving waveforms when the first SF is the setup sub-field for all the cells and the second SF is the selective setup sub-field.

First, the driving waveforms in the setup sub-field for all the cells and the operations thereof will be described. Since the first half and the second half of the setup period for all the cells are the same as those in the first embodiment, detailed description thereof is omitted. When the shortage of the priming or the like causes the larger discharge time lag, the excessive positive wall charges are stored on the scan electrodes SCN1 to SCNn in the first half and the second half of the setup period for all the cells. In addition, since the write period and the sustain period are the same as those in the first embodiment, explanation is omitted.

Then, the driving waveforms in the selective setup sub-field and the operations thereof will be described. The selective setup period is divided into two periods: the first half (the first period) and the abnormal charges erase part (the second period) when described.

In the first half of the setup period, the sustain electrodes SUS1 to SUSn are held at Ve1 (V), the data electrodes D1 to Dm are held at 0 (V), and the dropping ramp waveform voltage gradually dropping from the voltage Vq (V) to the voltage Va (V) is applied to the scan electrodes SCN1 to SCNn. Then, the weak setup discharge is generated in the discharge cell in which the sustain discharge has been induced in the sustain period of the preceding sub-field, so that the wall voltages on the scan electrode SCNi and the sustain electrode SUS1 are weakened, and the wall voltage on the data electrode Dk is adjusted to the value suitable for the write operation. Meanwhile, the discharges are not generated and the wall charges are kept constant in the state at the end of the setup period of the preceding sub-field in the discharge cells in which the write discharges and the sustain discharges have not been induced in the preceding sub-field. As described above, the setup operation in the selective setup sub-field is the selective setup operation that generates the setup discharges in the discharge cells in which the sustain discharges have been induced in the preceding sub-field.

In the abnormal charges erase part in the setup period, the sustain electrodes SUS1 to SUSn are returned to 0 (V). After the first positive voltage Vs (V) that does not reach the discharge start voltage is applied to the scan electrodes SCN1 to SCNn for 5 to 20 μs, the positive voltage Vd (V) is applied to the data electrodes D1 to Dm for 100 ns to 1 μs, and the negative voltage Va (V) is then applied to the scan electrodes SCN1 to SCNn for such a short period of time as not more than 5 μs. Furthermore, the second positive voltage Vs (V) is applied to the scan electrodes SCN1 to SCNn, and the ramp waveform voltage gradually dropping toward the voltage (Va+Vset2) (V) is then applied to the scan electrodes SCN1 to SCNn. During this period, the discharges are not generated in the discharge cells of which discharge start voltage is not decreased among the discharge cells in which the setup discharges have been stably performed, and the wall voltage is held in a state in the second half of the setup period. In the discharge cells in which the abnormal positive wall charges are stored on the scan electrodes SCN1 to SCNn and the discharges cells of which discharge start voltage is decreased, however, application of the voltage Vs (V) to the scan electrodes SCN1 to SCNn causes the voltage of the discharge cells to exceed the discharge start voltage, thus generating the strong discharges to invert the wall voltage on the scan electrodes SCN1 to SCNn.

In the discharge cells of which discharge start voltage is decreased among the discharge cells in which the abnormal wall charges are stored and the discharge cells of which discharge start voltage is decreased, the discharges are generated by application of the positive voltage Vd (V) to the data electrodes D1 to Dm. These discharges seem as if the erase discharges are forcibly terminated in the middle since the positive voltage Vd (V) is applied to the data electrodes D1 to Dm for a very short period of time. These discharges adjust the wall charges in the cells such that the write operation can be normally performed in the write period. The discharge cells that are discharged by the positive voltage Vd (V) applied to the data electrodes D1 to Dm are not discharged by the negative voltage Va (V) applied to the scan electrodes SCN1 to SCNn, the second positive voltage Vs (V) applied to the scan electrodes SCN1 to SCNn and the ramp waveform voltage gradually dropping toward the voltage (Va+Vset2) (V) subsequently applied to the scan electrodes SCN1 to SCNn.

The discharge cells in which the abnormal wall charges are stored are discharged by the positive voltage Vd (V) applied to the data electrodes D1 to Dm or the negative voltage Va (V) applied to the scan electrodes SCN1 to SCNn. When the discharges are generated by the positive voltage Vd (V) applied to the data electrodes D1 to Dm, the discharges seem as if the erase discharges are forcibly terminated in the middle, but the state in which the wall charges are abnormally stored is resolved. The discharge cells are not discharged by the negative voltage Va (V) applied to the scan electrodes SCN1 to SCNn, the second positive voltage Vs (V) applied to the scan electrodes SCN1 to SCNn and the ramp waveform voltage gradually dropping toward the voltage (Va+Vset2) (V) subsequently applied to the scan electrodes SCN1 to SCNn, preventing the wall charges from being erased.

The discharge cells in which the erase discharges have been generated by the negative pulse voltage Va (V) applied to the scan electrodes SCN1 to SCNn are brought into any of the state in which the wall voltage has been erased, the state in which the wall voltage has been insufficiently erased by the weak erase discharges and the state in which the wall voltage has been inverted by the strong erase discharges.

The discharge cells in the state in which the wall charges have been erased are not discharged by the second positive voltage Vs (V) applied to the scan electrodes SCN1 to SCNn and the ramp waveform voltage gradually dropping toward the voltage (Va+Vset2) (V) subsequently applied to the scan electrodes SCN1 to SCNn.

The discharge cells in the state in which the wall charges have been insufficiently erased by the weak erase discharges are not discharged by the second positive voltage Vs (V) applied to the scan electrodes SCN1 to SCNn but subjected to the weak discharges caused by the ramp waveform voltage gradually dropping toward the voltage (Va+Vset2) (V) applied to the scan electrodes SCN1 to SCNn, thus causing the wall charges to be adjusted such that the normal writing can be performed.

The discharge cells in which the wall voltage has been inverted by the strong erase discharges are discharged by the second positive voltage Vs (V) applied to the scan electrodes SCN1 to SCNn to cause the wall charges to be again inverted, and subjected to the weak discharges caused by the ramp waveform voltage gradually dropping toward the voltage (Va+Vset2) (V) subsequently applied to the scan electrodes SCN1 to SCNn, thus causing the wall charges to be adjusted such that the normal writing can be performed.

When the abnormal wall charges are stored in the discharge cells, the discharge cells with the large storage amount of the wall charges and the small discharge time lag are more likely to be discharged by the positive voltage Vd (V) applied to the data electrodes D1 to Dm. The discharge cells that have not been discharged by the positive voltage Vd (V) applied to the data electrodes D1 to Dm are discharged by the negative voltage Va (V) applied to the scan electrodes SCN1 to SCNn. The weak discharges are induced by the dropping ramp waveform voltage applied to the scan electrodes SCN1 to SCNn in the discharge cells of which wall charges have been insufficiently erased by the negative voltage Va (V) applied to the scan electrodes SCN1 to SCNn, and the discharges are induced by the second positive voltage Vs (V) applied to the scan electrodes SCN1 to SCNn and the weak discharges are then induced by the dropping ramp waveform voltage applied to the scan electrodes SCN1 to SCNn in the discharge cells in which the wall charges have been inverted by the negative voltage Va (V) applied to the scan electrodes SCN1 to SCNn.

As described above, the discharge cells in which the abnormal wall charges are stored are discharged by any of the positive voltage Vd (V) applied to the data electrodes D1 to Dm, the negative voltage Va (V) applied to the scan electrodes SCN1 to SCNn and the dropping ramp waveform voltage applied to the scan electrodes SCN1 to SCNn, thereby resolving the state in which the wall charges are abnormally stored.

Since the write period and the sustain period are the same as those in the setup sub-field for all the cells, explanation is omitted.

As described above, the positive voltage Vd (V) is applied to the data electrodes D1 to Dm in the period between the application of the positive voltage Vs (V) to the scan electrodes SCN1 to SCNn and the application of the negative voltage Va (V) to the scan electrodes SCN1 to SCNn in the abnormal charges erase part in the selective setup period. This adjusts the wall charges of the discharge cells of which discharge start voltage is significantly decreased, prevents the wall charges from being erased in the abnormal wall charges erase part, and enables the normal write operation.

While two sub-fields, for example, are shown as sub-fields in which the selective setup operations are performed in the present embodiment, the present invention is not limited to this. For example, the selective setup operation may be performed in a plurality of sub-fields, and the abnormal charges erase part may be provided in at least one selective setup period of the plurality of selective setup periods.

Next, description is made of one example of the control of the data electrode driving circuit, the scan electrode driving circuit and the sustain electrode driving circuit in the selective setup period in the embodiment of the present invention while referring to the drawing. The data electrode driving circuit, the scan electrode driving circuit and the sustain electrode driving circuit employed in the third embodiment of the present invention are the same as those in the first embodiment.

Figure 12:
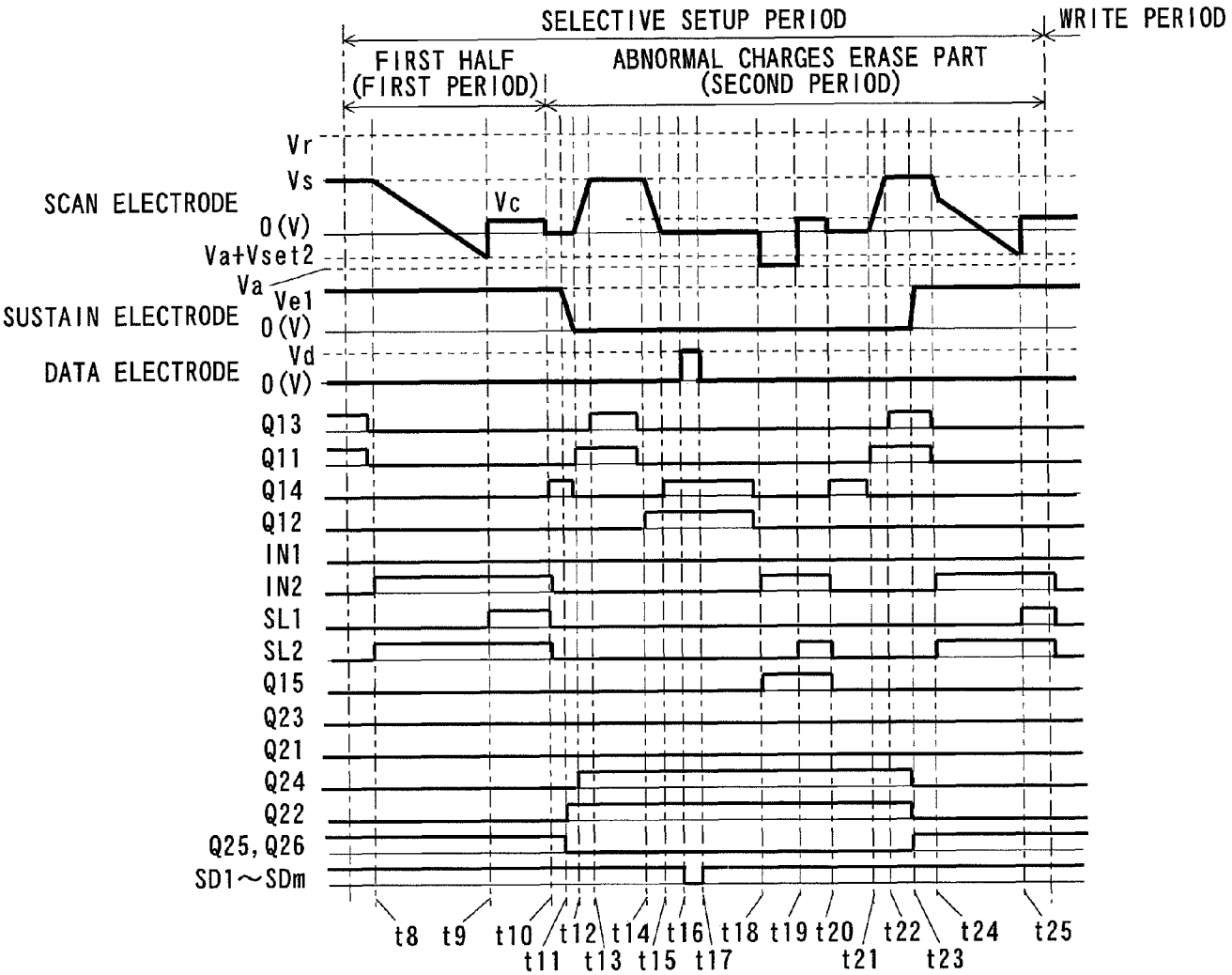
FIG. 12 is a timing chart for explaining an example of the operation of a scan electrode driving circuit in a setup period for all cells in the third embodiment of the present invention.
Figure 13:
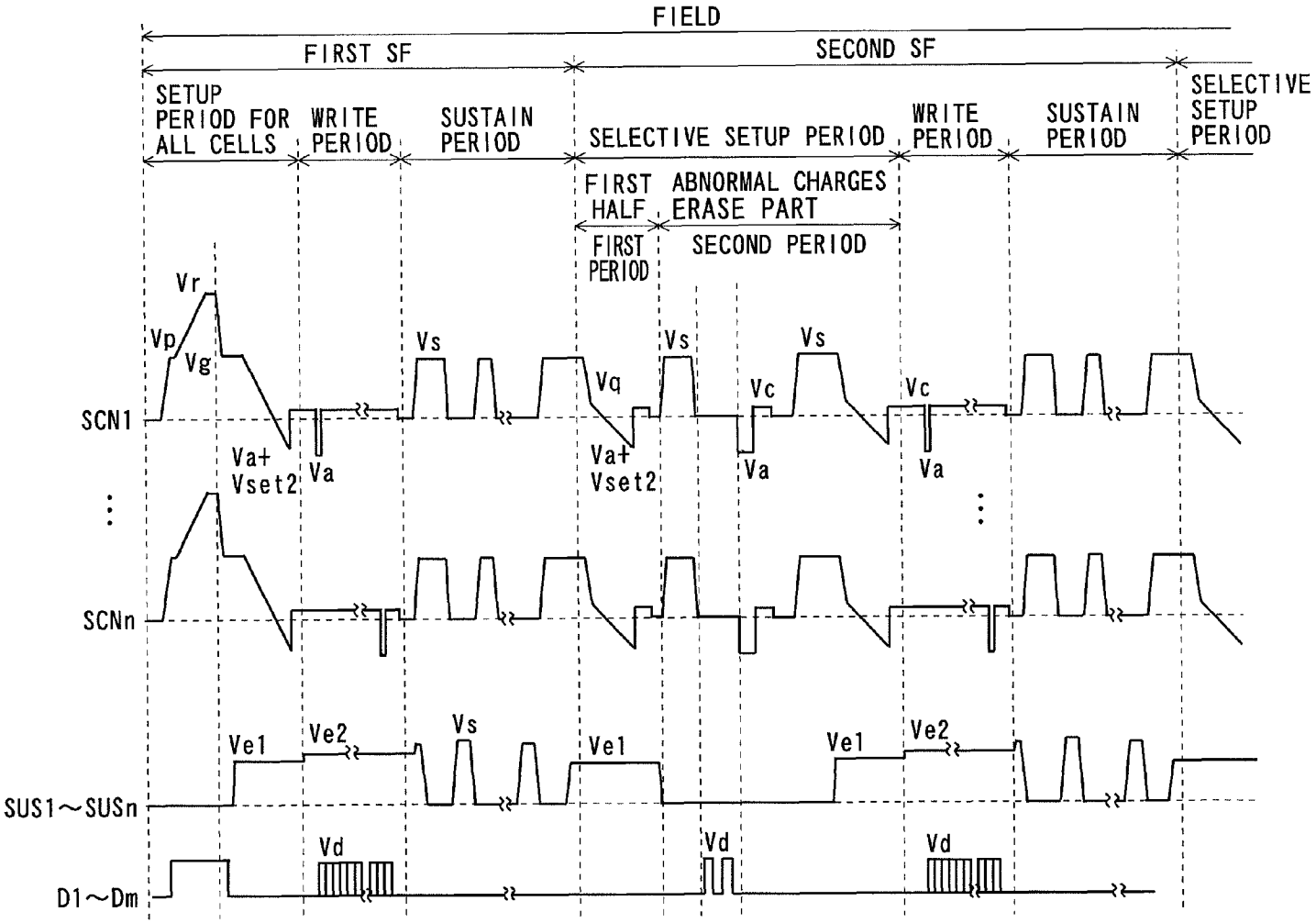
FIG. 13 is a diagram showing driving waveforms applied to respective electrodes of a panel in a fourth embodiment of the present invention.

FIG. 12 is a timing chart for explaining examples of the operations of the data electrode driving circuit 52, the scan electrode driving circuit 53 and the sustain electrode driving circuit 54 in the selective setup period in the third embodiment of the present invention. Since a period from time t8 to t25 is the same as that in the first embodiment of the present invention, detailed description thereof is omitted.

That is, the operations of the data electrode driving circuit 52, the scan electrode driving circuit 53 and the sustain electrode driving circuit 54 in the period from time t8 to time t20 of the driving timing chart of the setup period for all the cells shown in FIG. 8 in the first embodiment of the present invention are the same as the operations of the data electrode driving circuit 52, the scan electrode driving circuit 53 and the sustain electrode driving circuit 54 in the selective setup period in the present embodiment.

As described above, the data electrode driving circuit has the circuit configuration shown in FIG. 5, the scan electrode driving circuit 53 has the circuit configuration shown in FIG. 6, the sustain electrode driving circuit has the circuit configuration shown in FIG. 7, and the data electrode driving circuit 52, the scan electrode driving circuit 53 and the sustain electrode driving circuit 54 are driven at the timings shown in the timing chart of FIG. 12 in the present embodiment. Accordingly, the driving waveforms applied to the data electrodes D1 to Dm, the scan electrodes 22 and the sustain electrodes 23 in the selective setup period can be achieved in the present embodiment. In particular, the positive pulse voltage is applied to the data electrodes in the period between the application of the positive pulse voltage to the scan electrodes and the application of the negative pulse voltage to the scan electrodes in the abnormal charges erase part of the selective setup period. This allows the normal write discharges to be performed in the subsequent write period, resulting in display of images with excellent quality.

While the example in which the abnormal wall charges erase part is provided in the selective setup period is shown in the present embodiment, the same effects can be obtained in a plasma display device implementing driving waveforms including both the sub-field in which the abnormal charges erase part is provided in the setup period for all the cells described in the first embodiment and the sub-field of the present embodiment.

(4) Fourth Embodiment

A fourth embodiment of the present invention will be described. The structural diagram of a plasma display device of the present embodiment is the same as that of the second embodiment. The present embodiment is different from the second embodiment in that the abnormal charges erase part is provided not in the setup period for all the cells but in the selective setup period. FIG. 6 is a diagram showing driving waveforms applied to the respective electrodes of the panel in the third embodiment of the present invention, and shows the driving waveforms in the setup sub-field for all the cells and the selective setup sub-field. FIG. 6 shows the driving waveforms when the first SF is the setup sub-field for all the cells and the second SF is the selective setup sub-field, for example.

First, the driving waveforms in the setup sub-field for all the cells and the operations thereof will be described.

Since the first half and the second half of the setup period for all the cells are the same as those in the first embodiment, detailed description thereof is omitted. When the shortage of the priming or the like causes the larger discharge time lag, the excessive positive wall charges are stored on the scan electrodes SCN1 to SCNn in the first half and the second half of the setup period for all the cells. Since the write period and the sustain period are the same as those in the first embodiment, explanation is omitted.

Then, the driving waveforms in the selective setup sub-field and the operations thereof will be described. The selective setup period is divided into two periods: the first half (the first period) and the abnormal charge erase part (the second period) when described.

In the first half of the setup period, the sustain electrodes SUS1 to SUSn are held at Ve1 (V), the data electrodes D1 to Dm are held at 0 (V), and the dropping ramp waveform voltage gradually dropping from Vq (V) to Va (V) is applied to the scan electrodes SCN1 to SCNn. Then, the weak setup discharge is generated in the discharge cell in which the sustain discharge has been induced in the sustain period of the preceding sub-field, so that the wall voltages on the scan electrode SCNi and the sustain electrode SUSi are weakened, and the wall voltage on the data electrode Dk is adjusted to the value suitable for the write operation. Meanwhile, the discharges are not generated and the wall charges are kept constant in the state at the end of the setup period of the preceding sub-field in the discharge cells in which the write discharges and the sustain discharges have not been induced in the preceding sub-field. As described above, the setup operation in the selective setup sub-field is the selective setup operation that generates the setup discharges in the discharge cells in which the sustain discharges have been induced in the preceding sub-field.

In the abnormal charges erase part in the setup period, the sustain electrodes SUS1 to SUSn are returned to 0 (V). The first positive voltage Vs (V) that does not reach the discharge start voltage is applied to the scan electrodes SCN1 to SCNn for 5 to 20 μs, and the first positive voltage Vd (V) is applied to the data electrodes D1 to Dm for 100 ns to 1 μs. After the interval of 100 ns to 1 μs, the second positive voltage Vd (V) is applied to the data electrodes D1 to Dm for 100 ns to 1 μs. Furthermore, the second positive voltage Vs (V) is applied to the scan electrodes SCN1 to SCNn, and the ramp waveform voltage gradually dropping toward the voltage (Va+Vset2)

(V) is then applied to the scan electrodes SCN1 to SCNn. At this time, the application time of the first positive voltage Vd (V) applied to the data electrodes D1 to Dm is set shorter than the application time of the second positive voltage Vd (V) applied to the data electrodes D1 to Dm. After that, the negative voltage Va (V) is applied to the scan electrodes SCN1 to SCNn for such a short period of time as not more than 5 μs. During this period, the discharges are not generated in the discharge cells of which discharge start voltage is not decreased among the discharge cells in which the setup discharges have been stably performed, and the wall voltage is held in the state in the second half of the setup period. In the discharge cell in which the abnormal positive wall charges are stored on the scan electrode SCNi and the discharge cell of which discharge start voltage is decreased, however, application of the voltage Vs (V) to the scan electrodes SCN1 to SCNn causes the voltage of the discharge cells to exceed the discharge start voltage, thus generating the strong discharge to invert the wall voltage on the scan electrode SCNi.

The first positive voltage Vd (V) is applied to the data electrodes D1 to Dm of the discharge cells of which discharge start voltage is significantly decreased. When there is no significant difference in the discharge time lags of the respective discharge cells of red, green and blue, the discharges are induced in the discharge cells of red, green and blue by the first positive voltage Vd (V) applied to the data electrodes D1 to Dm to allow the wall charges to be adjusted so that the write operation can be normally performed in the write period. When the discharge time lags of the respective discharge cells of red, green and blue are significantly different, however, the discharge cells with the large discharge time lag are not discharged by the first positive voltage Vd (V) applied to the data electrodes D1 to Dm in some cases. When the discharge time lag of the discharge cells of green is small and the discharge time lags of the discharge cells of red and blue are large, for example, the application time of the first positive voltage Vd (V) applied to the data electrodes D1 to Dm is determined according to the characteristics of the discharge cells of green with the small discharge time lag.

The application time of the first positive voltage Vd (V) is set so short as about 150 ns according to the characteristics of the discharge cells of green with the small discharge time lag. Description is made of the need for adjusting the first positive voltage Vd (V) applied to the data electrodes D1 to Dm to the characteristics of the discharge cells of green with the small discharge time lag. When the application time of the first positive voltage Vd (V) is too long, such as about 400 ns, the erase discharges cannot be terminated in the middle and the wall charges are erased in the discharge cells of green with the small discharge time lag. Therefore, the application time of the first positive voltage Vd (V) applied to the data electrodes D1 to Dm is set very short according to the characteristics of the discharge cells of green with the small discharge time lag. The discharge cells of blue and red with the large discharge time lags are not discharged in some cases by the first positive voltage Vd (V) applied for the short period of time. Therefore, the second positive voltage Vd (V) is subsequently applied to the data electrodes D1 to Dm. The application time of the second positive voltage Vd (V) is determined according to the characteristics of the discharge cells of red and blue with the large discharge time lags. The discharge cells of blue and red that have not been discharged by the first positive voltage Vd (V) applied to the data electrodes D1 to Dm for the short period of time because of the large discharge time lags are discharged by the second positive voltage Vd (V) applied to the data electrodes D1 to Dm. The application time of the second positive voltage Vd (V) applied to the data electrodes D1 to Dm is about 400 ns.

Since the discharge cells of green with the small discharge time lag are discharged by the first positive voltage Vd (V) applied to the data electrodes D1 to Dm, those discharge cells are not discharged by the second positive voltage Vd (V) applied to the data electrodes D1 to Dm. In this manner, the discharge cells of green with the small discharge time lag are discharged by the first positive voltage Vd (V) applied to the data electrodes D1 to Dm, and the discharge cells, which have not been discharged by the first positive voltage Vd (V) applied to the data electrodes D1 to Dm, among the discharge cells of red and blue with the large discharge time lags, are discharged by the second positive voltage Vd (V) applied to the data electrodes D1 to Dm. These discharges cause the wall charges in the discharge cells to be adjusted such that the write operation can be normally performed in the write period.

The discharge cells of which discharge start voltage is decreased are discharged by either of the first positive voltage Vd (V) applied to the data electrodes D1 to Dm and the second positive voltage Vd (V) applied to the data electrodes D1 to Dm, and are not discharged by the negative voltage Va (V) applied to the scan electrodes SCN1 to SCNn. The discharge cells of which discharge start voltage is decreased are not discharged by the negative voltage Va (V) applied to the scan electrodes SCN1 to SCNn, the second positive voltage Vs (V) applied to the scan electrodes SCN1 to SCNn and the ramp waveform voltage gradually dropping toward the voltage (Va+Vset2) (V) subsequently applied to the scan electrodes SCN1 to SCNn, preventing the wall charges from being erased.

The discharge cells in which the abnormal wall charges are stored are discharged by any of the first positive voltage Vd (V) applied to the data electrodes D1 to Dm, the second positive voltage Vd (V) applied to the data electrodes D1 to Dm and the negative voltage Va (V) applied to the scan electrodes SCN1 to SCNn. When the discharge cells are discharged by the positive voltage Vd (V) applied to the data electrodes D1 to Dm or the second positive voltage Vd (V) applied to the data electrodes D1 to Dm, the discharges seem as if the erase discharges are forcibly terminated in the middle, but the state in which the wall charges are abnormally stored is resolved.

The discharge cells in which the erase discharges have been generated by the negative pulse voltage Va (V) applied to the scan electrodes SCN1 to SCNn are brought into any of the state in which the wall voltage has been erased, the state in which the wall voltage has been insufficiently erased by the weak erase discharges and the state in which the wall voltage has been inverted by the strong erase discharges.

The discharge cells in the state in which the wall charges have been erased are not discharged by the second positive voltage Vs (V) applied to the scan electrodes SCN1 to SCNn and the ramp waveform voltage gradually dropping toward the voltage (Va+Vset2) (V) subsequently applied to the scan electrodes SCN1 to SCNn.

The discharge cells in the state in which the wall charges have been insufficiently erased by the weak erase discharges are not discharged by the second positive voltage Vs (V) applied to the scan electrodes SCN1 to SCNn but subjected to the weak discharges caused by the ramp waveform voltage gradually dropping toward the voltage (Va+Vset2) (V) applied to the scan electrodes SCN1 to SCNn, thus causing the wall charges to be adjusted such that normal writing can be performed.

The discharge cells in the state in which the wall voltage has been inverted by the strong erase discharges are discharged by the second positive voltage Vs (V) applied to the scan electrodes SCN1 to SCNn to cause the wall charges to be again inverted, and subjected to the weak discharges caused by the ramp waveform voltage gradually dropping toward the voltage (Va+Vset2) (V) subsequently applied to the scan electrodes SCN1 to SCNn, thus causing the wall charges to be adjusted such that the normal writing can be performed.

When the abnormal wall charges are stored in the discharge cells, the discharge cells with the large storage amount of the wall charges and the small discharge time lag are more likely to be discharged by the first positive voltage Vd (V) applied to the data electrodes D1 to Dm. The discharge cells that have not been discharged by the first positive voltage Vd (V) applied to the data electrodes D1 to Dm are discharged by the second positive voltage Vd (V) applied to the data electrodes D1 to Dm or the negative voltage Va (V) applied to the scan electrodes SCN1 to SCNn. The weak discharges are induced by the dropping ramp waveform voltage applied to the scan electrodes SCN1 to SCNn in the discharge cells of which wall charges have been insufficiently erased by the negative voltage Va (V) applied to the scan electrodes SCN1 to SCNn, and the discharges are induced by the second positive voltage Vs (V) applied to the scan electrodes SCN1 to SCNn and the weak discharges are induced by the dropping ramp waveform voltage applied to the scan electrodes SCN1 to SCNn in the discharge cells in which the wall charges have been inverted by the negative voltage Va (V) applied to the scan electrodes SCN1 to SCNn.

As described above, in the discharge cells in which the abnormal wall charges are stored, the discharges are induced by any of the first positive voltage Vd (V) applied to the data electrodes D1 to Dm, the second positive voltage Vd (V) applied to the data electrodes D1 to Dm, the negative voltage Va (V) applied to the scan electrodes SCN1 to SCNn and the dropping ramp waveform voltage applied to the scan electrodes SCN1 to SCNn, thereby resolving the state in which the wall charges are abnormally stored.

Since the write period and the sustain period are the same as those in the setup sub-field for all the cells, explanation is omitted.

As described above, the first positive voltage Vd (V) and the second positive voltage Vd (V) are applied to the data electrodes D1 to Dm in the period between the application of the positive voltage Vs (V) to the scan electrodes SCN1 to SCNn and the application of the negative voltage Va (V) to the scan electrodes SCN1 to SCNn in the abnormal charges erase part in the selective setup period. This adjusts the wall charges of the discharge cells of which discharge start voltage is significantly decreased, prevents the wall charges from being erased in the abnormal wall charges erase part, and enables the normal write operation even when the respective discharge cells of red, green and blue have the different characteristics such as the discharge time lags.

While two sub-fields, for example, are shown as sub-fields in which the selective setup operations are performed in the present embodiment, the present invention is not limited to this. For example, the selective setup operation may be performed in a plurality of sub-fields, and the abnormal charges erase part may be provided in at least one selective setup period of the plurality of selective setup periods.

As described above, the wall charges of the discharge cells of which discharge start voltage is significantly decreased are adjusted in the abnormal charges erase part of the setup period, so that images with excellent quality can be displayed according to the method of driving the panel of the present embodiment.

Next, description is made of one example of the control of the data electrode driving circuit, the scan electrode driving circuit and the sustain electrode driving circuit in the selective setup period in the present embodiment while referring to the drawing. The data electrode driving circuit, the scan electrode driving circuit and the sustain electrode driving circuit employed in the present embodiment are the same as those in the first embodiment.

Figure 14:
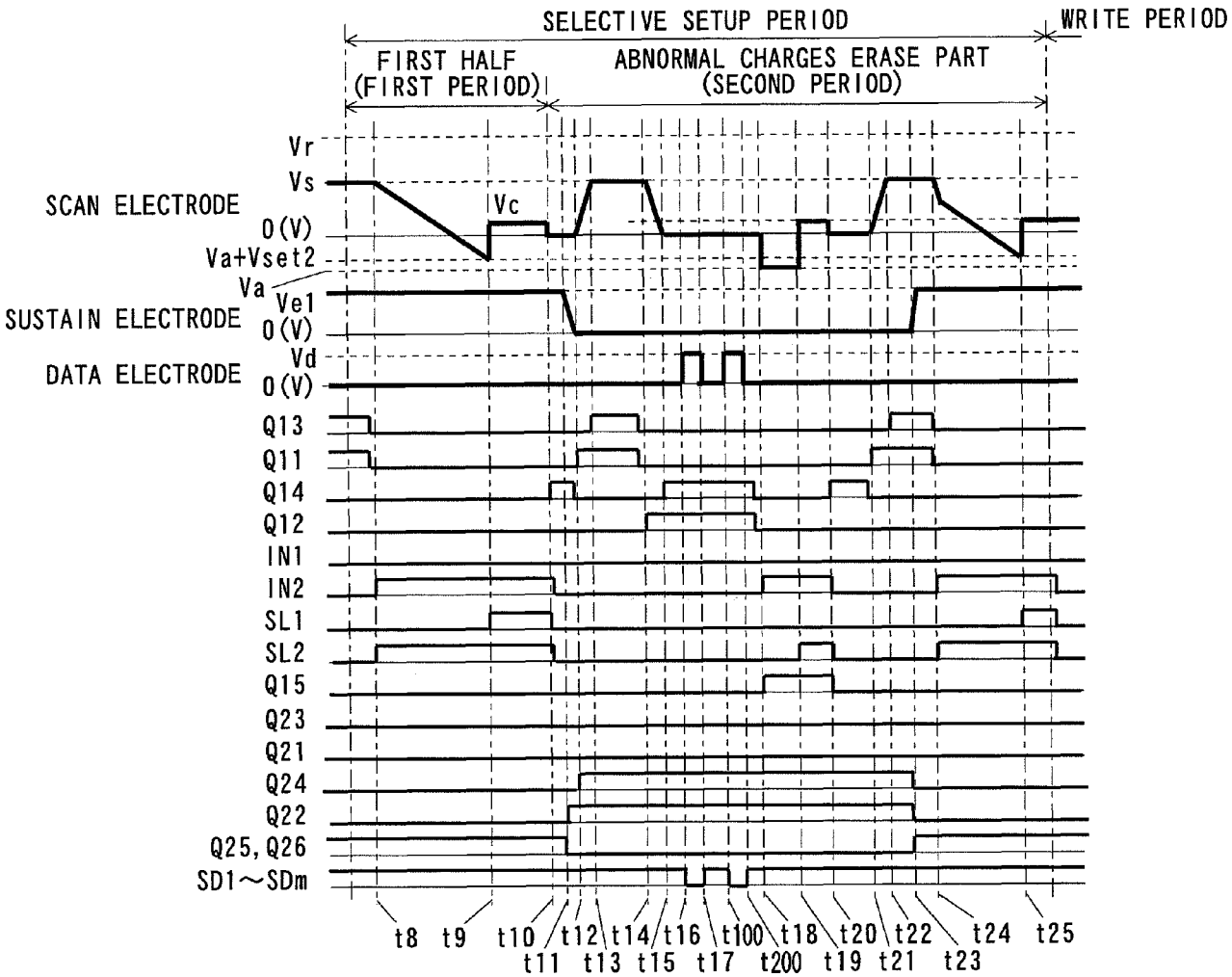
FIG. 14 is a timing chart for explaining an example of the operation of a scan electrode driving circuit in a setup period for all cells in the fourth embodiment of the present invention.

FIG. 14 is a timing chart for explaining examples of the operations of the data electrode driving circuit 52, the scan electrode driving circuit 53 and the sustain electrode driving circuit 54 in the selective setup period in the fourteenth embodiment of the present invention. Since the period from time t8 to t25 is the same as that in the second embodiment, detailed description is omitted. That is, the operations of the data electrode driving circuit 52, the scan electrode driving circuit 53 and the sustain electrode driving circuit 54 in the period from t8 to time t20 of the driving timing chart of the setup period for all the cells shown in FIG. 10 in the second embodiment are the same as the operations of the data electrode driving circuit 52, the scan electrode driving circuit 53 and the sustain electrode driving circuit 54 in the selective setup period in the present embodiment.

As described above, the data electrode driving circuit has the circuit configuration shown in FIG. 5, the scan electrode driving circuit 53 has the circuit configuration shown in FIG. 6, the sustain electrode driving circuit has the circuit configuration shown in FIG. 7, and the data electrode driving circuit 52, the scan electrode driving circuit 53 and the sustain electrode driving circuit 54 are driven at the timings shown in the timing chart of FIG. 14 in the present embodiment. Accordingly, the driving waveforms applied to the data electrodes D1 to Dm, the scan electrodes 22 and the sustain electrodes 23 in the selective setup period in the present embodiment can be achieved. In particular, the positive pulse voltage is applied twice to the data electrodes in the period between the application of the positive pulse voltage to the scan electrodes and the application of the negative pulse voltage to the scan electrodes in the abnormal charges erase part of the selective setup period, thereby allowing the normal write discharges to be performed in the subsequent write period. This results in display of images with excellent quality even when the discharge cells have the different discharge time lags.

While the example in which the abnormal charges erase part is provided in the selective setup period is shown in the present embodiment, the same effects can be obtained in a plasma display device implementing driving waveforms including both the sub-field in which the abnormal charges erase part is provided in the setup period for all the cells described in the first embodiment and the sub-field of the present embodiment.

INDUSTRIAL APPLICABILITY

The present invention is capable of displaying images with excellent quality by preventing wall charges from being erased in an abnormal wall charges erase part in a setup period in discharge cells of which discharge start voltage is significantly decreased, and is useful as an image display device and the like using a plasma display panel.

The invention claimed is:

1. A plasma display device that drives a plasma display panel including a plurality of discharge cells at intersections of a scan electrode and a sustain electrode with a plurality of data electrodes by a sub-field method in which one field period includes a plurality of sub-fields, comprising:

a scan electrode driving circuit that drives said scan electrode;

a sustain electrode driving circuit that drives said sustain electrode; and a data electrode driving circuit that drives said data electrodes, wherein at least one sub-field of said plurality of sub-fields includes a setup period in which wall charges of said plurality of discharge cells are adjusted such that write discharges can be performed, said scan electrode driving circuit applies a rising ramp waveform voltage to said scan electrode to generate first setup discharges between said scan electrode as an anode and said sustain electrode and said data electrodes as cathodes in a first period within said setup period, applies a dropping ramp waveform voltage to said scan electrode to generate second setup discharges between said scan electrode as a cathode and said sustain electrode and said data electrodes as anodes in a second period following said first period within said setup period, and applies a positive rectangular waveform voltage, a negative rectangular waveform voltage and a dropping ramp waveform voltage to said scan electrode in a third period following said second period within said setup period, and said data electrode driving circuit applies a positive rectangular waveform voltage to said data electrodes in a period between application of said positive rectangular waveform voltage to said scan electrode and application of said negative rectangular waveform voltage to said scan electrode in said third period.

2. The plasma display device according to claim 1, wherein said data electrode driving circuit sequentially applies two or more said positive rectangular waveform voltages to said data electrodes in said third period.

3. The plasma display device according to claim 1, wherein said data electrode driving circuit sequentially applies two or more positive rectangular waveform voltages to said data electrodes in said third period, and a voltage application period of the rectangular waveform voltage first applied to said data electrodes is the shortest among voltage application periods of the plurality of rectangular waveform voltages applied to said data electrodes.

4. A plasma display device that drives a plasma display panel including a plurality of discharge cells at intersections of a scan electrode and a sustain electrode with a plurality of data electrodes by a sub-field method in which one field period includes a plurality of sub-fields, comprising:

a scan electrode driving circuit that drives said scan electrode;

a sustain electrode driving circuit that drives said sustain electrode; and a data electrode driving circuit that drives said data electrodes, wherein at least one sub-field of said plurality of sub-fields includes a setup period in which wall charges of said plurality of discharge cells are adjusted such that write discharges can be performed, said scan electrode driving circuit applies a dropping ramp waveform voltage to said scan electrode to generate setup discharges between said scan electrode as a cathode and said sustain electrode and said data electrodes as anodes in a first period within said setup period, and applies a positive rectangular waveform voltage, a negative rectangular waveform voltage and a dropping ramp waveform voltage to said scan electrode in a second period following said first period within said setup period, and said data electrode driving circuit applies a positive rectangular waveform voltage to said data electrodes in a period between application of said positive rectangular waveform voltage to said scan electrode and application of said negative rectangular waveform voltage to said scan electrode in said second period.

5. A method of driving a plasma display device that drives a plasma display panel including a plurality of discharge cells at intersections of a scan electrode and a sustain electrode with a plurality of data electrodes by a sub-field method in which one field period includes a plurality of sub-fields, comprising the steps of:

driving said scan electrode;

driving said sustain electrode; and driving said data electrodes, wherein at least one sub-field of said plurality of sub-fields includes a setup period in which wall charges of said plurality of discharge cells are adjusted such that write discharges can be performed, said step of driving said scan electrode includes the steps of applying a rising ramp waveform voltage to said scan electrode to generate first setup discharges between said scan electrode as an anode and said sustain electrode and said data electrodes as cathodes in a first period within said setup period, applying a dropping ramp waveform voltage to said scan electrode to generate second setup discharges between said scan electrode as a cathode and said sustain electrode and said data electrodes as anodes in a second period following said first period within said setup period, and applying a positive rectangular waveform voltage, a negative rectangular waveform voltage and a dropping ramp waveform voltage to said scan electrode in a third period following said second period within said setup period, and said step of driving said data electrodes includes the step of applying a positive rectangular waveform voltage to said data electrodes in a period between application of said positive rectangular waveform voltage to said scan electrode and application of said negative rectangular waveform voltage to said scan electrode in said third period.

6. The method of driving the plasma display device according to claim 5, wherein said step of driving said data electrodes includes the step of sequentially applying two or more positive rectangular waveform voltages to said data electrodes in said third period.

7. The method of driving the plasma display device according to claim 5, wherein said step of driving said data electrodes includes the step of sequentially applying two or more positive rectangular waveform voltages to said data electrodes in said third period, wherein a voltage application period of the rectangular waveform voltage first applied to said data electrodes is the shortest among voltage application periods of the plurality of rectangular waveform voltages applied to said data electrodes.

8. A method of driving a plasma display device that drives a plasma display panel including a plurality of discharge cells at intersections of a scan electrode and a sustain electrode with a plurality of data electrodes by a sub-field method in which one field period includes a plurality of sub-fields, comprising the steps of:

driving said scan electrode;

driving said sustain electrode; and driving said data electrodes, wherein at least one sub-field of said plurality of sub-fields includes a setup period in which wall charges of said plurality of discharge cells are adjusted such that write discharges can be performed, said step of driving said scan electrode includes the steps of applying a dropping ramp waveform voltage to said scan electrode to generate setup discharges between said scan electrode as a cathode and said sustain electrode and said data electrodes as anodes in a first period in said setup period, and applying a positive rectangular waveform voltage, a negative rectangular waveform voltage and a dropping ramp waveform voltage to said scan electrode in a second period following said first period in said setup period, and said step of driving said data electrodes includes the step of applying a positive rectangular waveform voltage to said data electrodes in a period between application of said positive rectangular waveform voltage to said scan electrode and application of said negative rectangular waveform voltage to said scan electrode in said second period.

* * * * *